US005152531A

United States Patent [19]

Mo

[11] Patent Number: 5,152,531

[45] Date of Patent: Oct. 6, 1992

[54] WIRE PUZZLE WITH CAPTURE ELEMENT

[76] Inventor: Cheuong K. Mo, 5411 N. Glenwood St., Chicago, Ill. 60640

[21] Appl. No.: 557,723

[22] Filed: Jul. 25, 1990

[51] Int. Cl.[5] ..... A63F 9/08

[52] U.S. Cl. ..... 273/158

[58] Field of Search ..... 273/158; D21/106

[56] References Cited

U.S. PATENT DOCUMENTS

| | | | |
|---|---|---|---|
| D. 60,738 | 3/1922 | Schweikowski | 273/158 |
| D. 246,922 | 1/1978 | Heigh | 273/158 |
| D. 246,924 | 1/1978 | Heigh | 273/158 |
| D. 258,601 | 3/1981 | Smallwood | 273/158 |
| D. 304,045 | 10/1989 | Hasegawa | D21/106 |
| 1,726,952 | 9/1929 | Gonzales | 273/158 |
| 4,524,972 | 6/1985 | Wilmarth | 273/158 |
| 4,867,456 | 9/1989 | Weber et al. | 273/158 |
| 4,878,670 | 11/1989 | Bernauer | 273/158 |

FOREIGN PATENT DOCUMENTS

| | | | |
|---|---|---|---|
| 1189105 | 6/1985 | Canada | 273/158 |

*Primary Examiner*—Paul E. Shapiro
*Assistant Examiner*—William M. Pierce

[57] ABSTRACT

A puzzle having multiple elements, with loop portions at the ends of one U-shaped element interlocking a portion of another U-shaped element, whereby planar heart elements having dimensions not passable through the loop portions are each manipulated into or out from a predetermined position of the interlocked U-shaped elements. A crossbar element, having closed loops at either end, has unequal size flange portions at their point of attachment to allow the crossbar to be manipulated through the loop portions of the U-shaped elements during the puzzles manufacture.

8 Claims, 32 Drawing Sheets

WIRE PUZZLE WITH CAPTURE ELEMENT

FIELD OF THE INVENTION

This invention relates to puzzles and amusement devices, and more particularly to a puzzle in which planar heart-shaped elements are manipulated into or out of multiple interlocked U-shaped elements.

BACKGROUND OF THE INVENTION

Basic structural configuration of similar puzzles in the prior arts provides a plurality of interlocked U-shaped elements each having loops at the ends of its upstanding portion. The uppermost U-shaped element is generally the largest in size, with the lowermost U-shaped element being the smallest. A rectilinear dumbell-shaped element is unremovably retained with the uppermost U-shaped element. The distinguishing features generally lie in the shape of a game piece that is maneuvered into or out of the U-shaped elements, and also in the number of U-shaped elements. The number of U-shaped elements in the prior arts varies from two up to four elements. For example, U.S. Pat. No. 4,867,456 which issued to H. C. Weber consists of two U-shaped elements, one dumbell-shaped element, and a solitary heart-shaped piece with an engaging ring together small enough to pass through the loops at the ends of the upstanding portions of the U-shaped elements. U.S. Pat. No. 4,497,489 which issued to W. O. Pelletier discloses two interlocked U-shaped elements, one dumbell-shaped element, and a solitary bow being small enough to pass through the loops of the U-shaped elements. U.S. Pat. No. 1,726,952 which issued to F. Gonzales consists of three U-shaped elements each having a loop at one end smaller than a loop on the other end, one dumbell-shaped element, and a fourth U-shaped element engaging the dumbell-shaped element in parallel with the uppermost U-shaped element. The parallel fourth element merely adds a few extra maneuvers to the solution of the same puzzle without said parallel fourth element. U.S. Pat. No. 4,878,670 which issued to L. W. Bernauer discloses three to four U-shaped elements, one dumbell-shaped element, a shorter dumbell-shaped element with end loops engaging upstanding portions of topmost U-shaped element, and a solitary heart-shaped element with tongue 24 extending out of a plane formed by the rest of the heart-shaped element. The present invention is different and more complex than the L. W. Bernauer puzzle. For examples, procedures FIG. 11 and FIG. 27 of said L. W. Bernauer puzzle are not executable if the heart-shaped element is planar. The present invention is similar to the F. Gonzales puzzle, and which further includes a U-shaped element interlocking the lowermost U-shaped element of the F. Gonzales puzzle, thereby adding a degree of complexity. The present invention also distinguishes from prior arts whereby a selected number of heart-shaped elements are each retained in a predetermined position of the interlocked U-shaped elements. For the purpose of guiding the puzzle solver towards solving the entire puzzle, the interlocked heart-shaped elements are first removed from the uppermost U-shaped element, then further interlocked heart-shaped elements are removed from the second uppermost U-shaped element, leading to the last interlocked heart-shaped element being removed from the lowermost U-shaped element. Such means maintain the interest of the puzzle solver by increasing the level of difficulty with the removal of each heart-shaped element.

SUMMARY OF THE INVENTION

The present invention involved maneuvering heart-shaped elements into or out of a plurality of interlocking elements. An important object of the invention is to provide a puzzle with parts easily assembled and economically manufactured with metals, thermosets, thermoplastics, and not limiting to ceramics, or a combination thereof. A second object of the invention is to provide a puzzle having a variety of colors for the purpose of appealing to the senses and also for the purpose of facilitating the identification of each element. A third object of the invention is to provide a puzzle having a solution disclosing unique steps for maneuvering a heart-shaped element into or out of each predetermined position of the U-shaped elements. Such predetermined positions are establishing to be obvious and easily recognized by a person not skilled in the art. Other objects and advantages of the present invention will become apparent as the description proceeds. A more detailed explanation of the invention is provided in the following description and claims, and is illustrated in the accompanying drawings.

BRIEF DESCRIPTION OF THE DRAWINGS

FIGS. 12–21, 32, and 33 illustrate steps involved in removing the heart element from the predetermined position of FIG. 5*g*.

FIGS. 24–29, and 34 illustrate steps involved in removing the heart element from the predetermined position of FIG. 5*d*.

FIGS. 32 and 33 illustrate steps involved in removing the heart element from the predetermined position of FIG. 5*b*.

FIG. 34 illustrates steps involved in removing the heart element from the predetermined position of FIG. 5*a*.

DETAILED DESCRIPTION OF THE PREFERRED EMBODIMENTS

Figure 1:
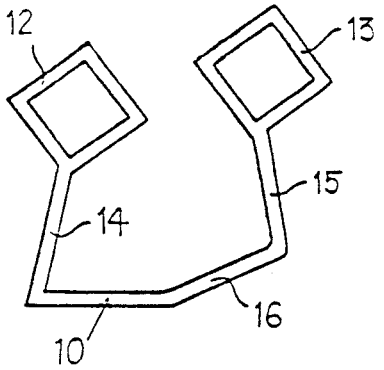
FIG. 1 is a perspective view of the U-shaped element.

FIG. 1 shows a U-shaped element 10 having upstanding portions 14, 15 resting on the ends of rung 16, with upstanding portions 14, 15 ending with closed loops 12, 13 at what is referred to herein as binders 12, 13. Binders 12, 13 are diamond or oval shaped, thereby allowing the same to be passed through. Upstanding portions 14, 15 are slightly angled inward.

Figure 2:
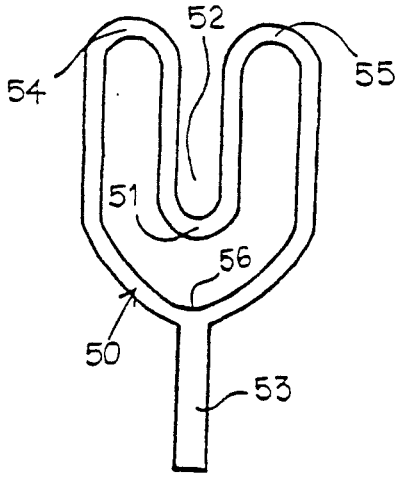
FIG. 2 is a perspective view of the heart-shaped element.

FIG. 2 shows a heart-shaped element 50 having a handle 53 connecting an apex 56, a pair of arcuate lobes 54, 55 surrounding a cleavage 51 at what is referred to herein as the centertip 51. The empty space 52 between arcuate lobes 54, 55 is also referred to herein as the tiphole 52.

Figure 3A:
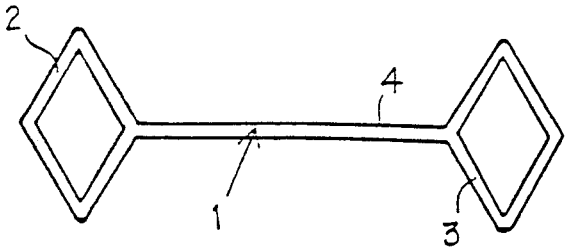
FIG. 3*a–b* is a perspective view of the dumbell-shaped element.
Figure 3B:
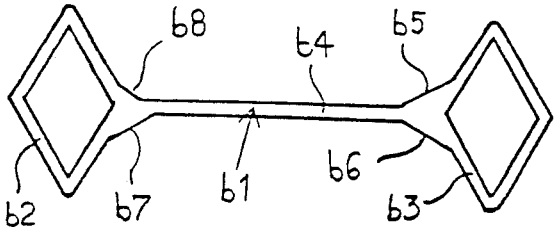

FIG. 3*a* shows a crossbar element 1 with loops 2, 3 at the ends of horizontal portion 4. Loops 2, 3 are also referred to herein as anchors 2, 3. Horizontal portion 4 is long enough to have anchors 2, 3 extending through binders 12, 13 of U-shaped element 10. Anchors 2, 3 are closed loops, each with or without a thru hole. Anchors 2, 3 are of such size that they may not be easily passed through binders 12, 13. Anchors 2, 3 are of such size that they may be passed through tiphole 52 of heart element 50 having arcuate lobes 54, 55 interlocking binders 43, 33, 23, and 13, or binders 42, 32, 22, and 12. FIG. 3*b* shows crossbar element b1 having wedge-shaped portions b5, b6, b7, and b8 being attached on its horizontal portion b4 and on its anchors b2, b3. Wedge-shaped portions b5, b6, and b7 are dimensioned large enough to prevent anchor b2, using side of anchor b2 having wedge-shaped portion b7, and anchor b3 to pass thru binders 12, and 13. Wedge-shaped portion b8 is small enough to enable a forced passage of anchor b2 thru binders 12 and 13 by using the side of anchor b2 having wedge-shaped portion b8. Wedge-shaped portion b8 is large enough to prevent easy removal of anchors b2 and b3 from binders 12 and 13 during normal handling and use of the present puzzle. Either crossbar elements 1 or b1 may be used in the present invention. For simplicity, only the crossbar element 1 of FIG. 3*a* will be illustrated in the following descriptions.

Figure 4A:
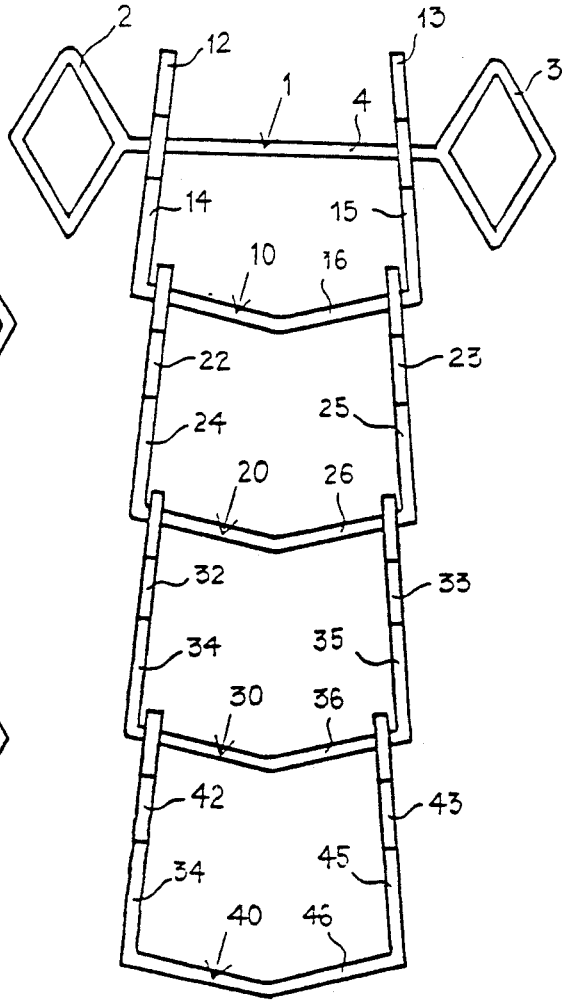
FIG. 4*a–d* shows the assemblies of all elements comprising the present invention excluding the solitary heart element of FIG. 2.
Figure 4B:
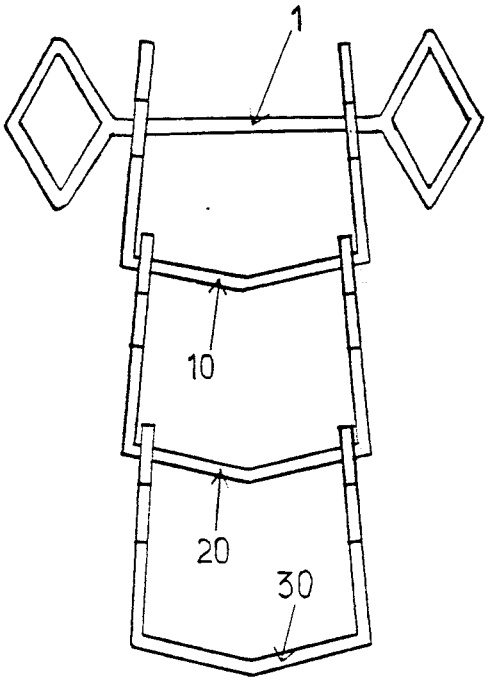
Figure 4C:
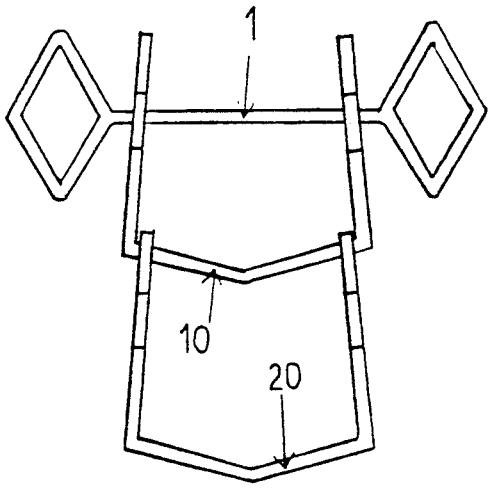
Figure 4D:
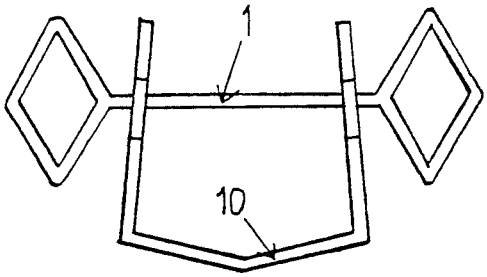

FIG. 4*a* shows four U-shaped elements 10, 20, 30, 40 and crossbar element 1 being interlocked together. U-shaped elements 10, 20, 30, and 40 are identically dimensioned to reduce the number of unique parts of the puzzle. Further structural descriptions on U-shaped element 10 will apply to U-shaped elements 20, 30, and 40, and vice versa. Upstanding portions 44, 45 of U-shaped element 40 are angled inward to freely hang binders 42, 43 in an interlocking position on rung 36 of U-shaped element 30 without interfering with the occupied space of upstanding portions 34, and 35 of U-shaped element 30. Rung 16 has a middle portion being the lowest position of U-shaped element 10. A heart element 50 being on rung 16 gravitationally rests on such middle portion, thereby not upsetting the balance of the assemblies of FIGS. 4*a–d*. The puzzle is being constructed such that binder 43 must be swung along upstanding portion 34 or 35, binder 33 must be swung along upstanding portion 24 or 25, and binder 23 must be swung along upstanding portion 14 or 15 to effect puzzle solution. FIG. 4*b* shows three U-shaped elements 10, 20, 30, and crossbar element 1 being interlocked together. FIG. 4*c* shows two U-shaped elements 10, 20, and crossbar element 1 being interlocked together. FIG. 4*d* shows U-shaped element 10, and crossbar element 1 being interlocked together.

Figure 5A:
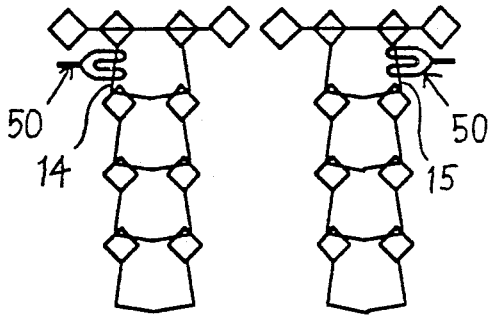
FIG. 5*a–g* shows the predetermined interlocking positions between the heart-shaped element and the assembly of FIG. 4*a*.
Figure 5B:
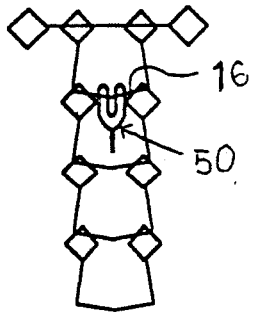
Figure 5C:
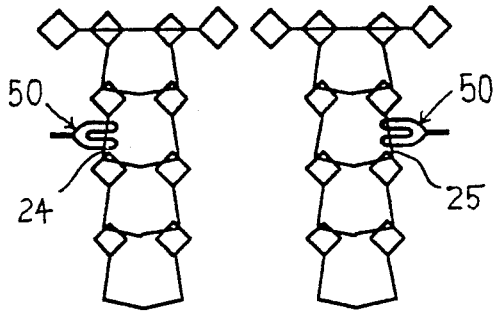
Figure 5D:
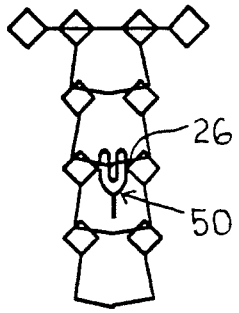
Figure 5E:
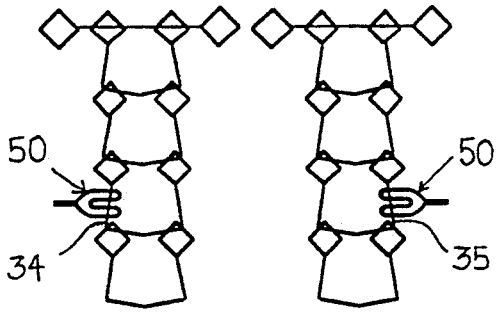
Figure 5F:
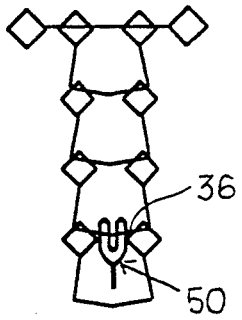
Figure 5G:
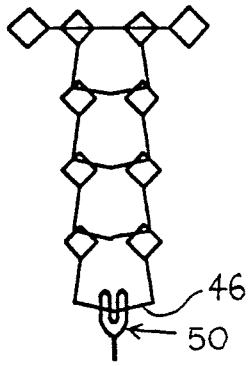

FIG. 5*a* shows the first and second of ten generally obvious predetermined positions whereby a heart element 50 is retained by upstanding portion 14 or 15 or U-shaped element 10 of the assembly of FIG. 4*a*. FIG. 5*a* is being referred to herein as LOOP1s with prefix "LOOP1" representing heart element 50 being interlocked with the first uppermost U-shaped element 10. Suffix "s" represents a side attachment of heart element 50. FIG. 5*b*, being referred to herein as LOOP1c with suffix "c" representing a center attachment of heart element 50, shows heart element 50 being retained on rung 16 of U-shaped element 10. FIG. 5*c* is referred to herein as LOOP2s with prefix "LOOP2" representing heart element 50 being interlocked with the second uppermost U-shaped element 20. Suffix "s" represents a side attachment of heart element 50 with heart element 50 being retained on upstanding portion 24 or 25 of U-shaped element 20. Names referring to FIGS. 5*d–g* follow the same representation concept as described by the foregoing names for FIGS. 5*a –c*. FIG. 5*d*, being referred to herein as LOOP 2c, shows heart element 50 being retained on rung 26 of U-shaped element 20. FIG. 5*e*, being referred to herein as LOOP3s, shows heart element 50 being retained on upstanding portion 34 or 35 of U-shaped element 30. FIG. 5*f*, being referred to herein as LOOP3c, shows heart element 50 being retained on rung 36 of U-shaped element 30. FIG. 5*g*, being referred to herein as LOOP4, shows heart element 50 being retained on rung 46 of U-shaped element 40. The puzzle is available with one or more heart elements 50 being retained in combination at predetermined positions as described in FIGS. 5*a–g*. For example, a puzzle may be provided with four heart elements 50 as positioned in LOOP1s, LOOP2s, LOOP3s, and LOOP4, or any combinations thereof from FIGS. 5*a–g* may be provided. The heart elements 50, starting with the topmost heart element 50, are engaged with U-shaped elements 40, 30, 20, 10, and crossbar 1 to become from the assembly of FIG. 4*a*. If desired, the object of the puzzle may be such that the heart elements 50, being initially free from the assembly of FIG. 4*a*, are engaged into the desired predetermined positions as desired in FIGS. 5*a–g* in a reversal of steps. The level of difficulty being increased from LOOP1s to LOOP4 keeps the puzzle solver interested as he removes each heart element 50 starting with the heart element 50 being retained on the uppermost U-shaped element 10, and finishing with the last heart element 50 being retained on the lowermost U-shaped element 40. FIGS. 5*a–g* show the present invention having a heart element 50 interlocking only the assembly of FIG. 4*a* only. It is important to note that the number of U-shaped elements included in the present invention is less than or equal to 4. FIG. 4*b* does not include LOOP3c nor LOOP4 procedures. FIG. 4*c* does not include LOOP2c, LOOP3c, LOOP3s, and LOOP4 procedures. FIG. 4*d* only has LOOP1s procedures. Solving FIGS. 5*a–g* will become apparent with the detailed maneuvers being shown in the following descriptions of the accompanying diagrams.

DETAILED DESCRIPTION OF THE SECOND PREFERRED EMBODIMENTS

The position of heart element 50 is first identified using FIGS. 5*a–g*, and then the solution instructions begin with the paragraph that has the corresponding "LOOP" heading. For example, if the heart element 50 is in the position as described in FIG. 5*e*, follow instructions immediately following the paragraph beginning with the word "LOOP3s" for removing the heart element 50 from the assemblies of FIGS. 4*a–b*. If the heart element 50 is in the position as described in FIG. 5*b*, follow instructions immediately following the paragraph beginning with the word "LOOP1c"for removing the heart element 50 from the assemblies of FIGS. 4*a–c*.

LOOP4

Figure 6:
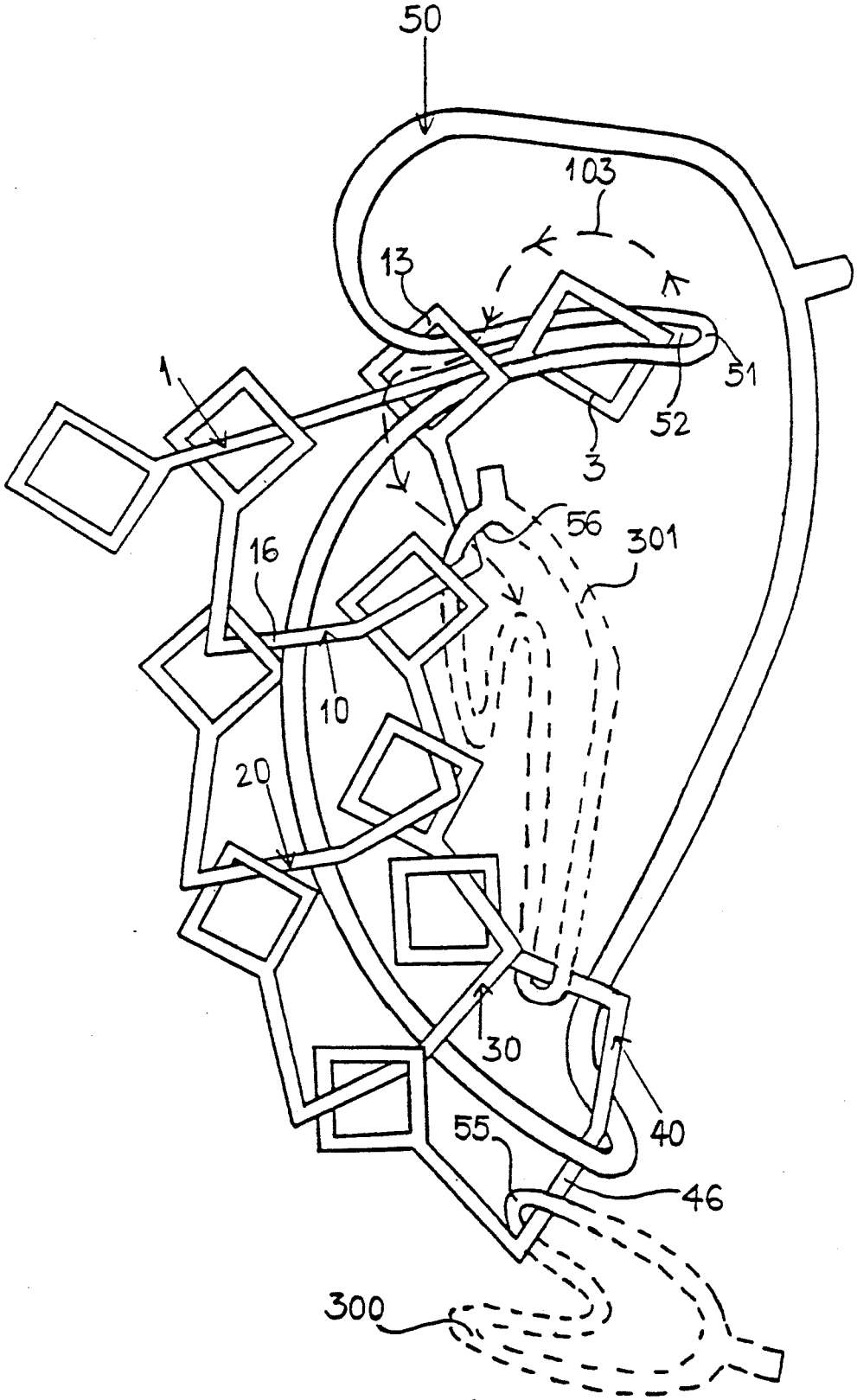
FIGS. 6–11, 14–21, 32, and 33 illustrate steps involved in removing the heart element from the predetermined position of FIG. 5*g*.
Figure 7:
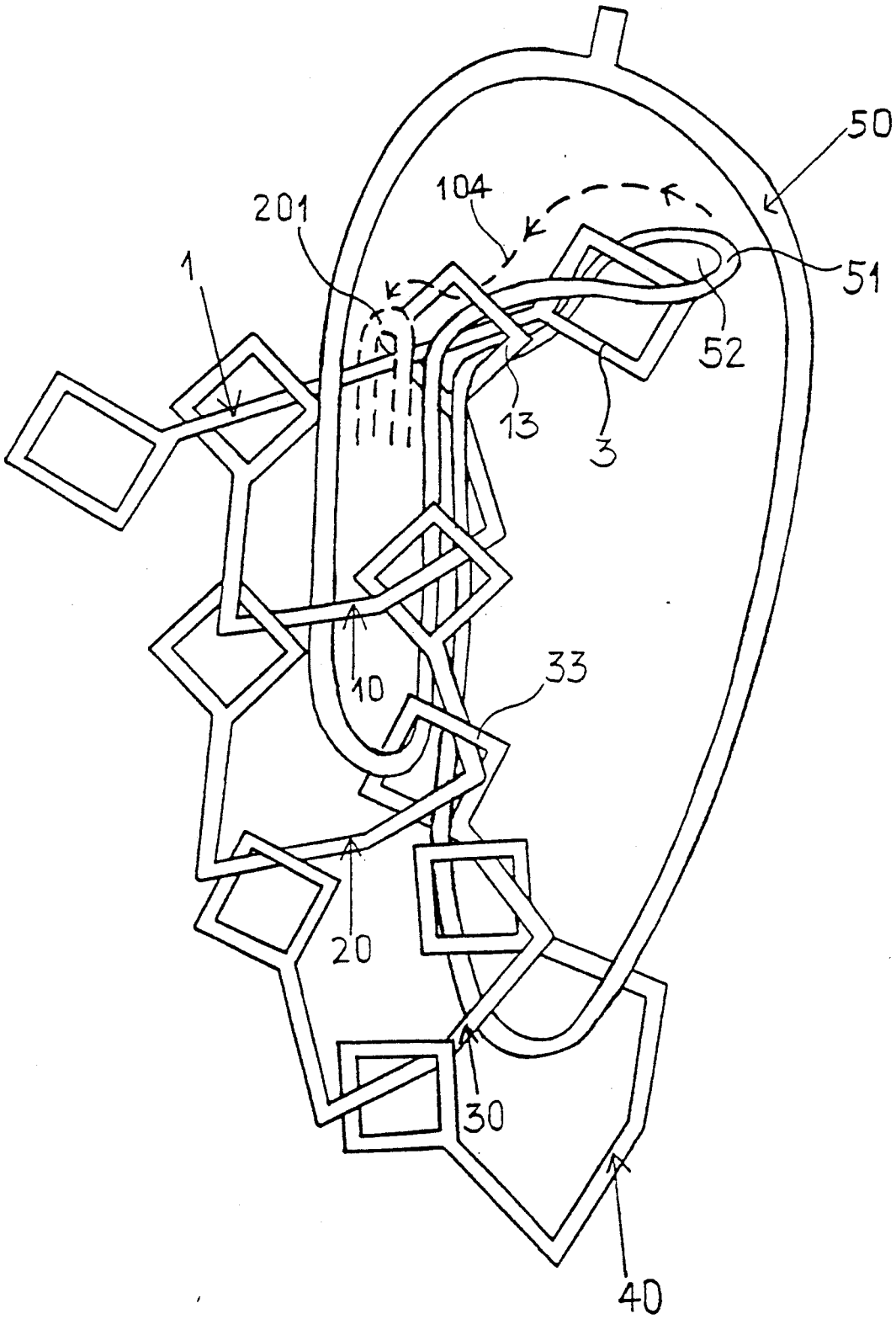
Figure 8:
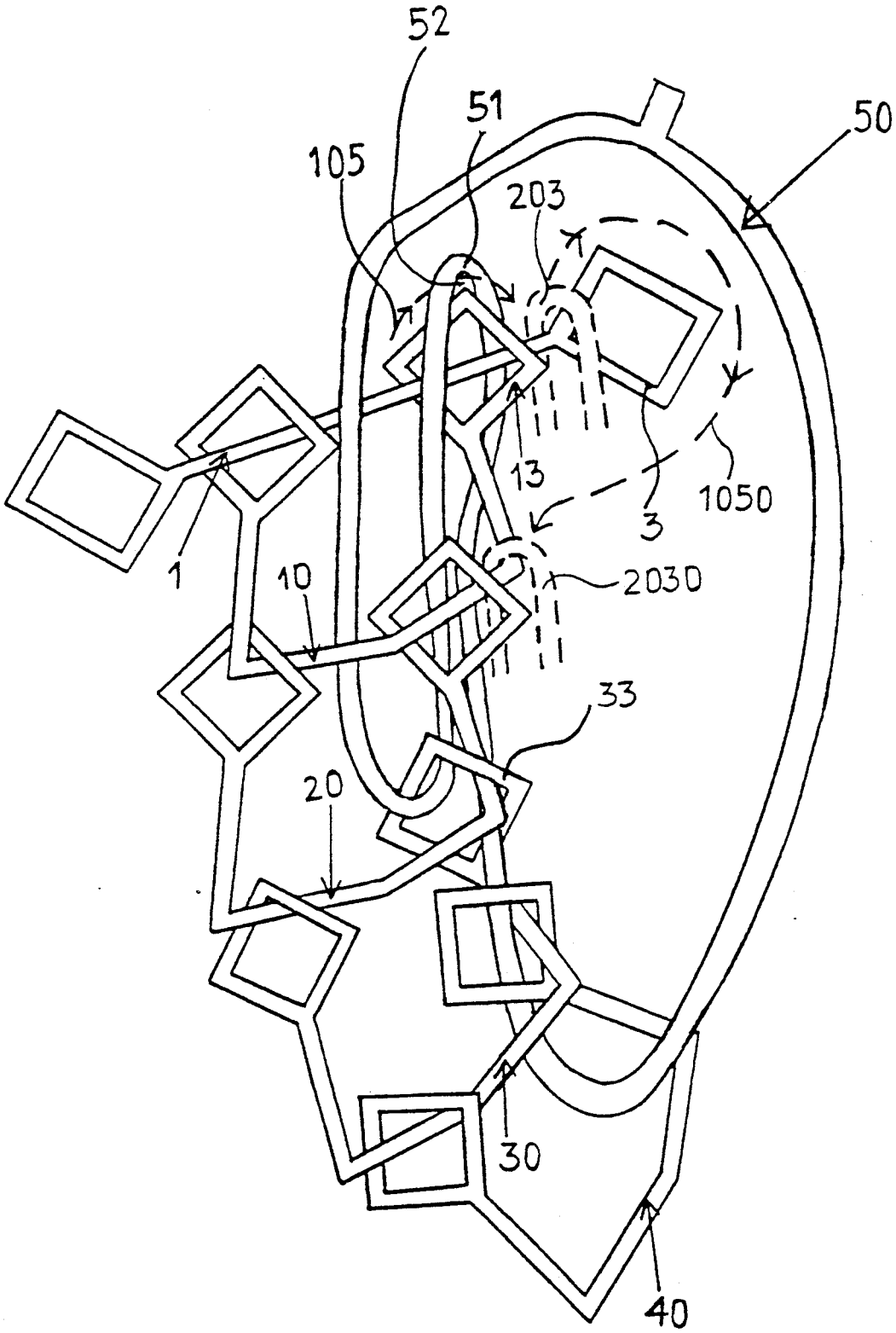
Figure 9:
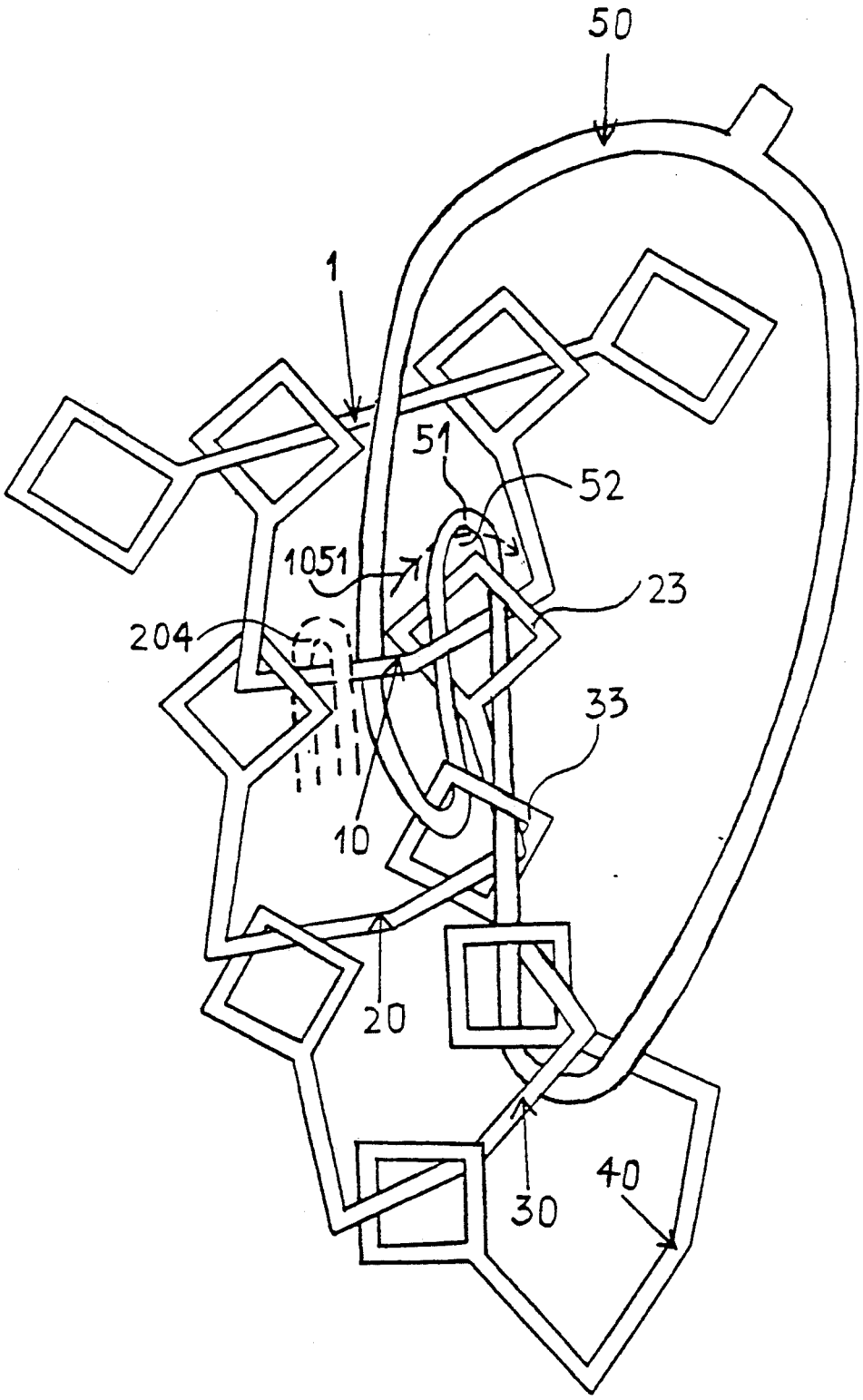
Figure 10:
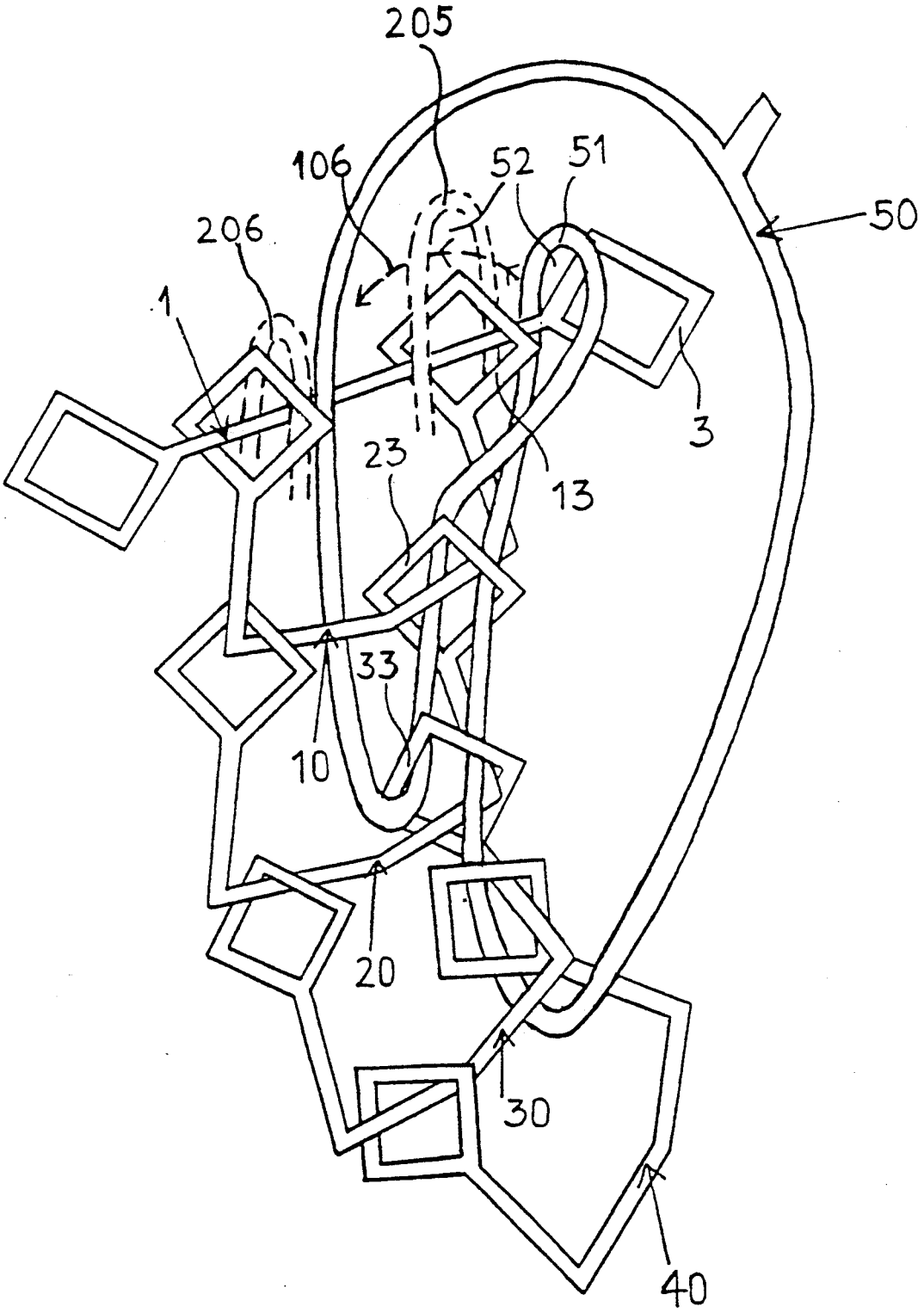
Figure 11:
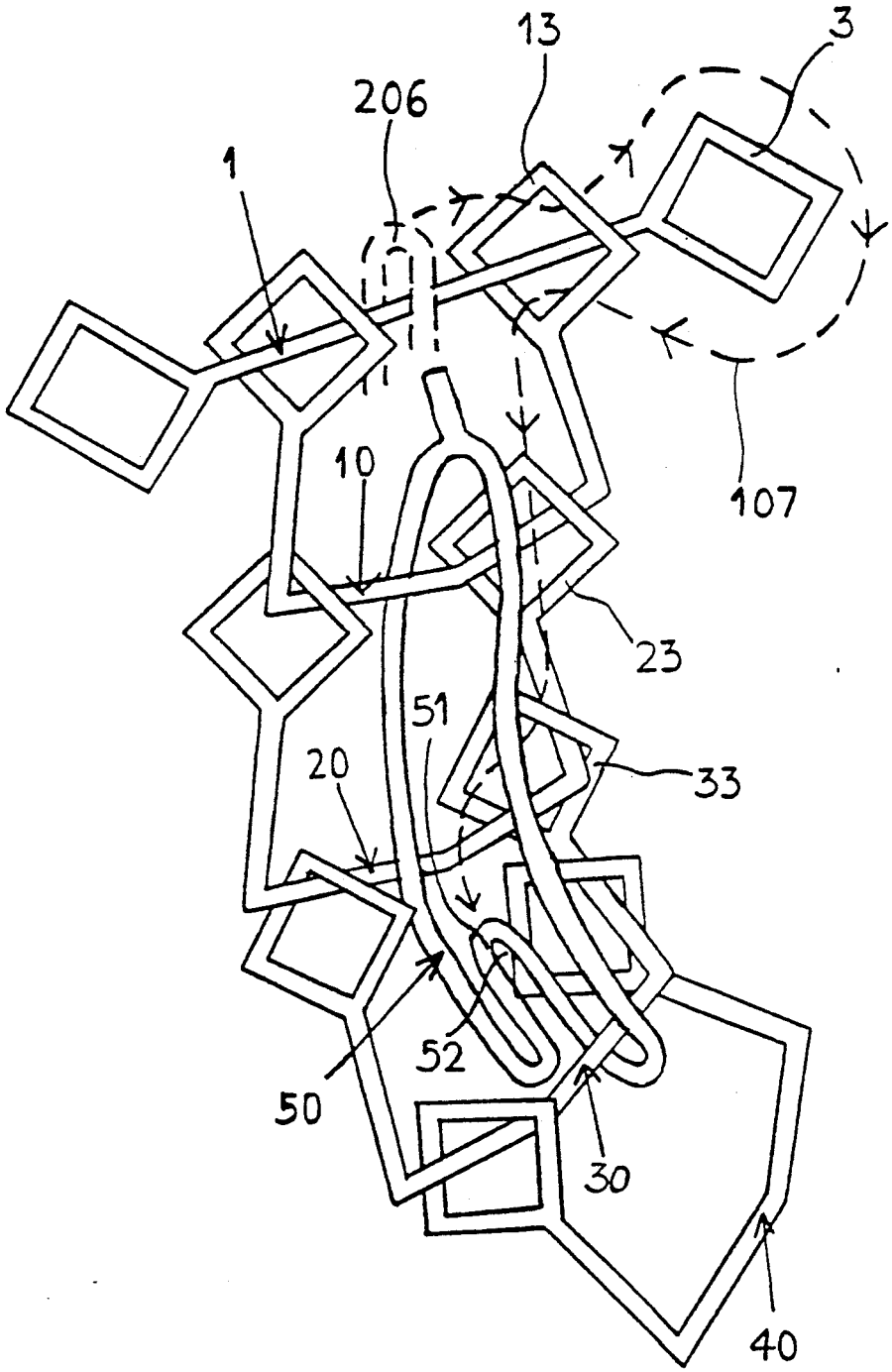

FIG. 6 shows heart element 50 initially in position 300 with arcuate lobe 55 retaining rung 46. Centertip 51 is inserted through binder 13 with U-shaped element 40 being behind U-shaped element 10. Path 103 shows tiphole 52 being passed across anchor 3, and then centertip 51 being removed from binder 13, ending at position 301 with apex 56 touching rung 16. In FIG. 7, centertip 51 is sequentially inserted through binders 33, and 13. Path 104 shows tiphole 52 being passed across anchor 3, and then centertip 51 being removed from binder 13, ending at position 201. In FIG. 8, tiphole 52 is straddled past binder 13 along path 105, with centertip 51 ending at position 203. From position 203, tiphole 52 is passed across anchor 3 along path 1050, with centertip 51 ending at position 2030. In FIG. 9, tiphole 52 is straddled past binder 23 along path 1051, with centertip 51 ending at position 204. In FIG. 10, centertip 51 is inserted through binder 23, then tiphole 52 is passed across anchor 3. Position 205 shows tiphole 52 being straddled past binder 13 along path 106, with centertip 51 ending at position 206. In FIG. 11, path 107 shows centertip 51 being inserted through binder 13 from position 206, then tiphole 52 being passed across anchor 3, and then centertip 51 being sequentially removed from binders 13, 23, and 33. Follow instructions immediately after the paragraph beginning with the word "LOOP3c.1".

LOOP3c

Figure 12:
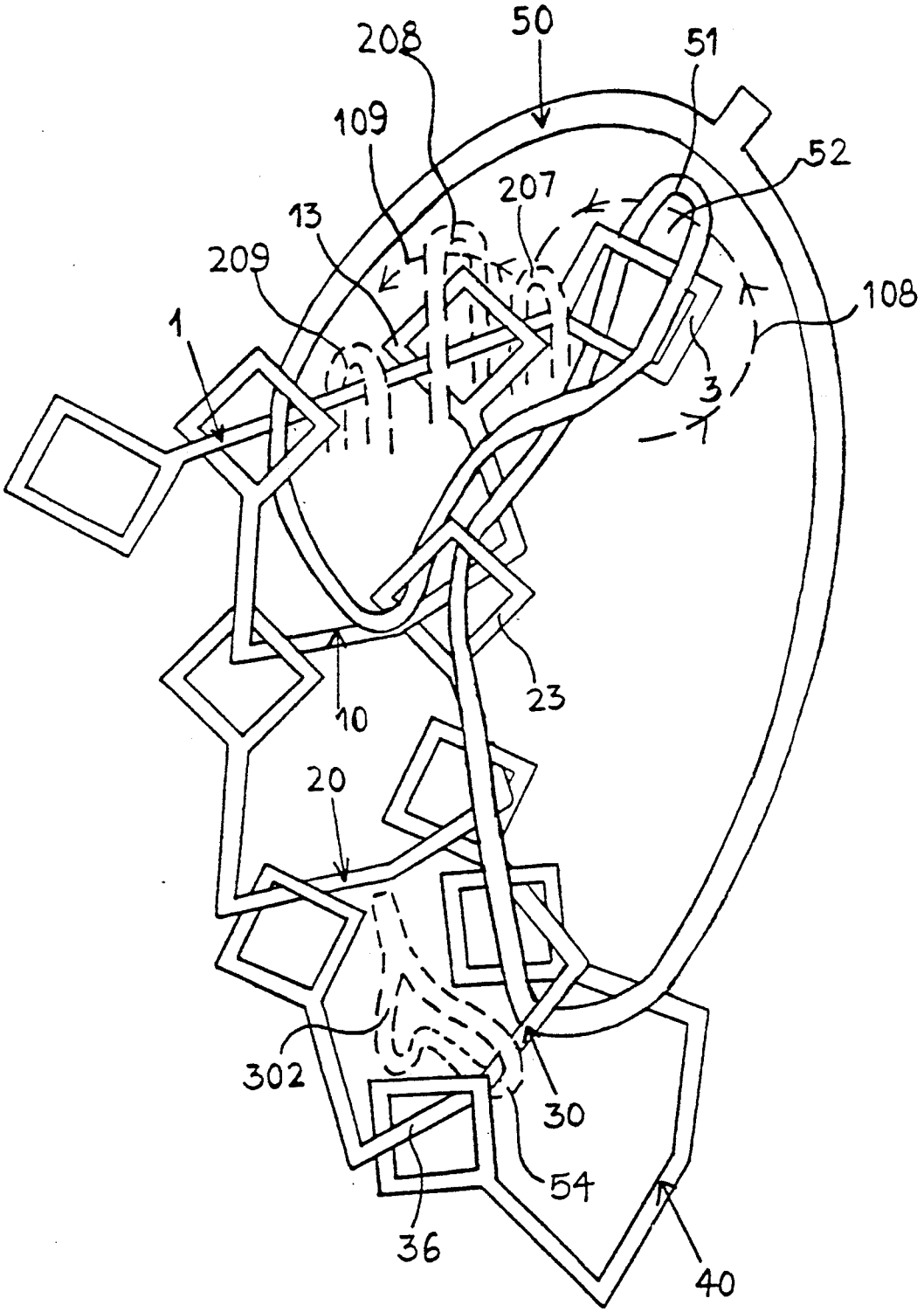
Figure 13:
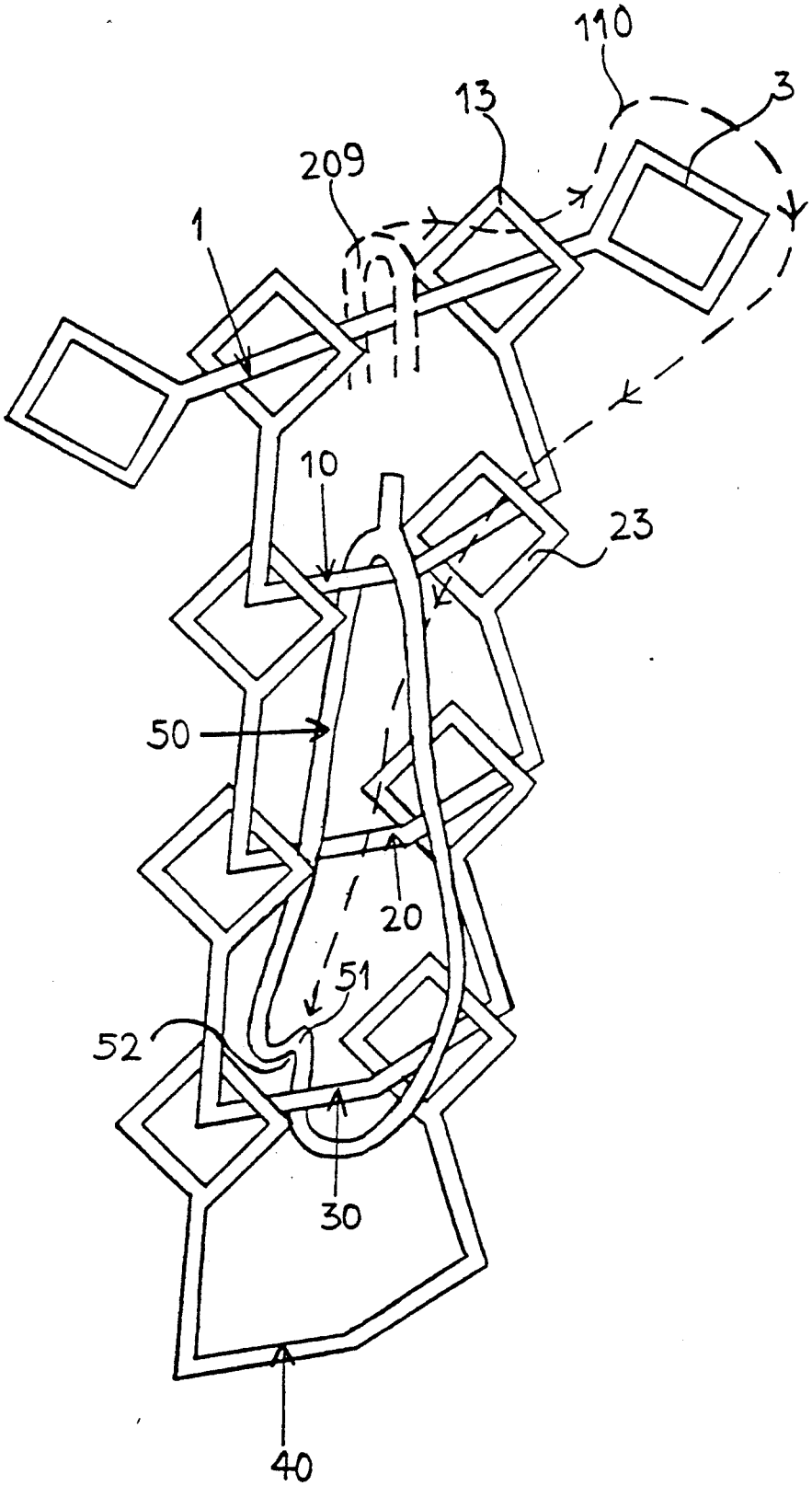

FIG. 12 shows heart element 50 initially in position 302, with arcuate lobe 54 retaining rung 36. Then, centertip 51 is inserted through binder 23, and then tiphole 52 is passed across anchor 3 along path 108, with centertip 51 ending at position 207. Position 208 shows tiphole 52 being straddled past binder 13 along path 109, with centertip 51 ending at position 209. In FIG. 13, path 110 shows centertip 51 initially at position 209 being inserted through binder 13, then tiphole 52 being passed across anchor 3, and then centertip 51 being removed from binder 23. Continue with "LOOP3c.1".

LOOP3c.1

Figure 14:
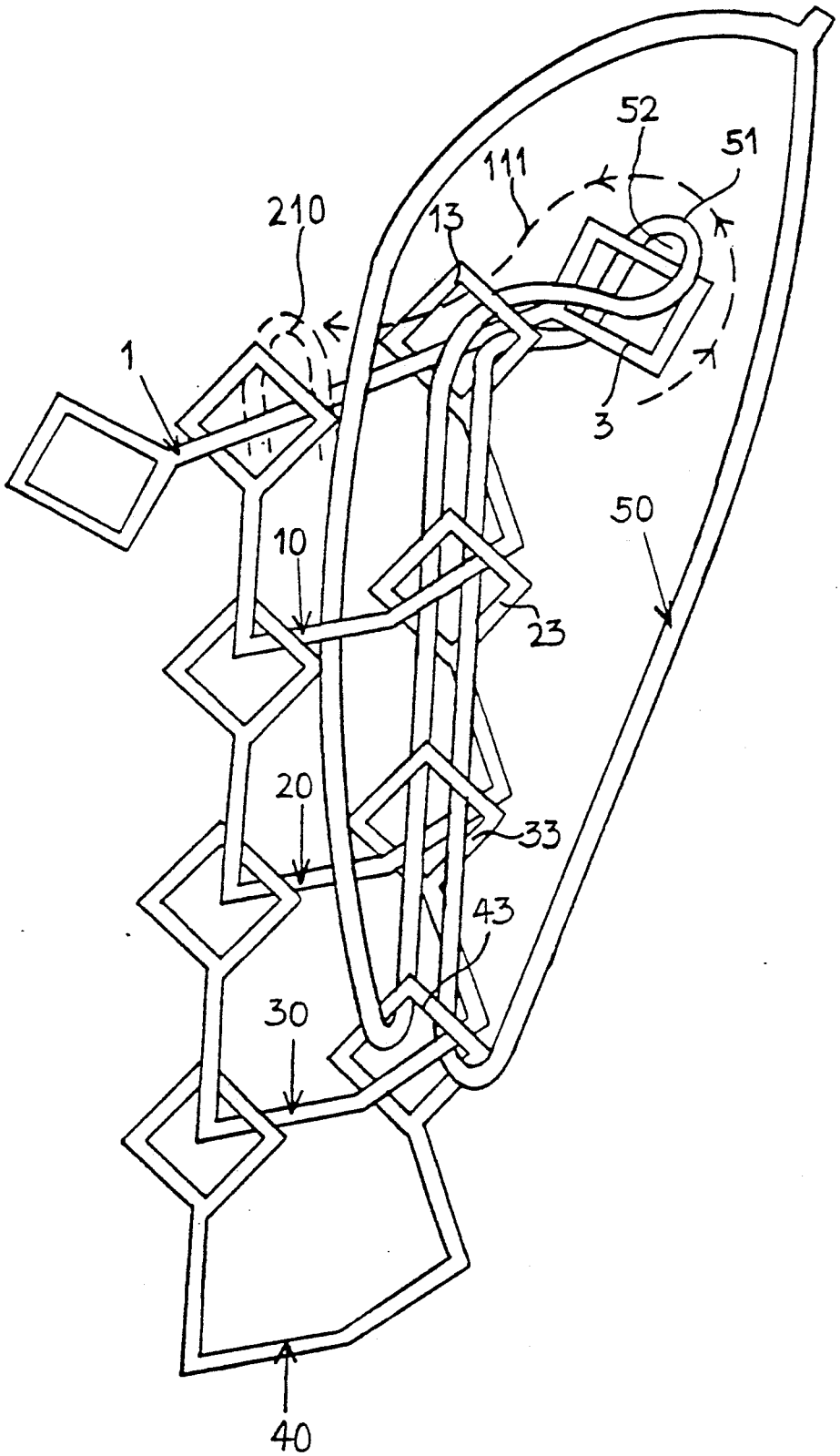
Figure 15:
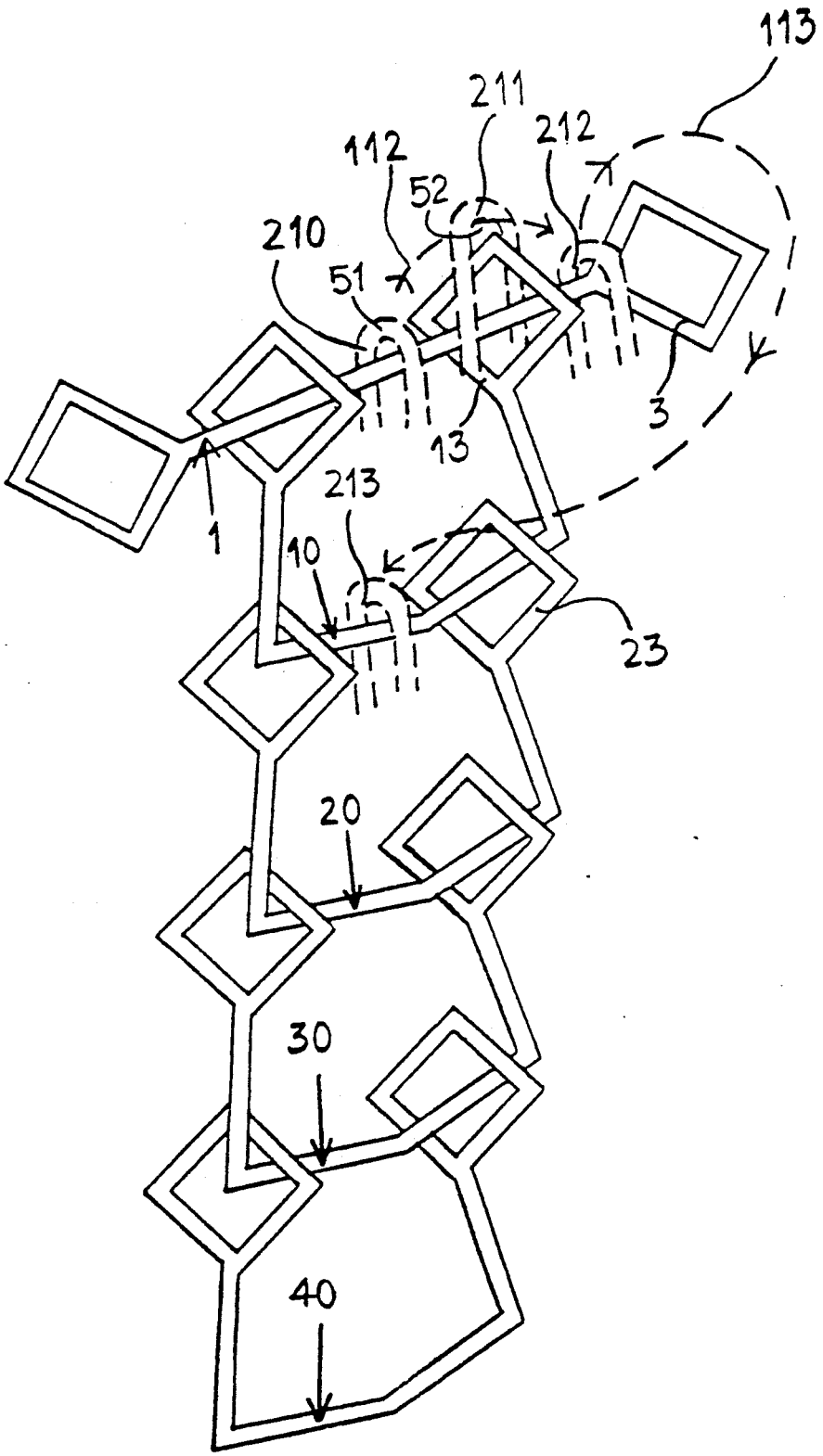
Figure 16:
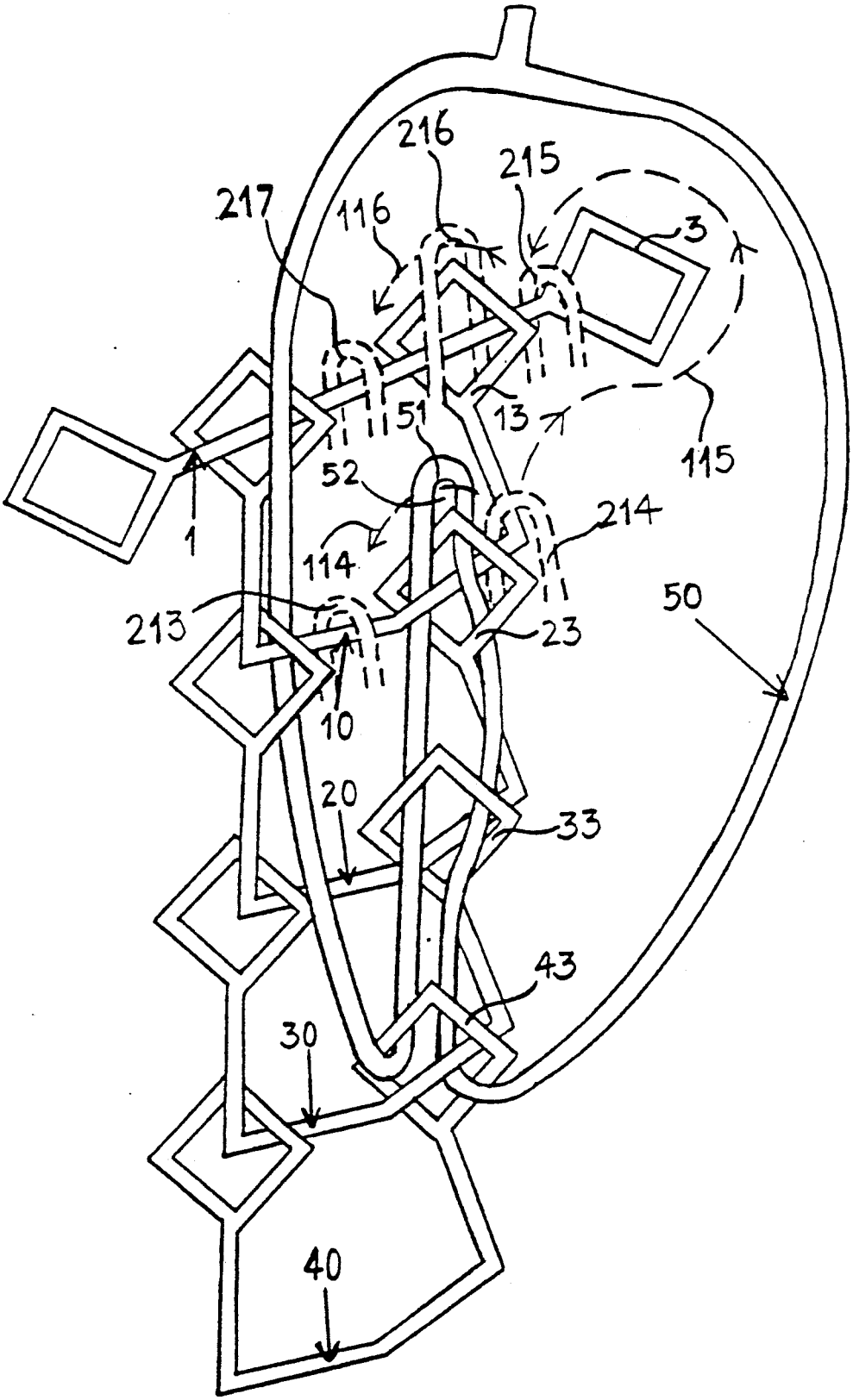
Figure 17:
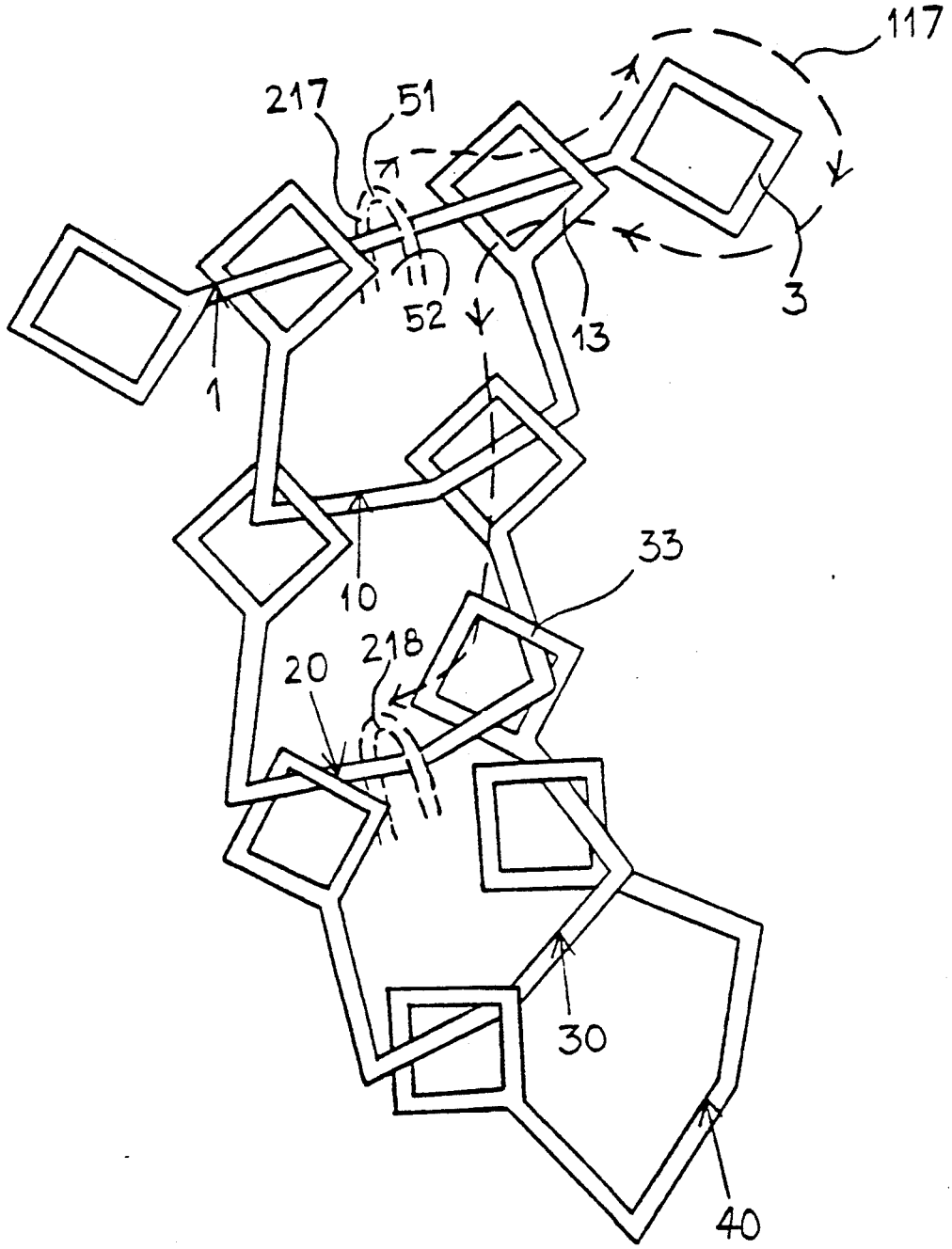
Figure 18:
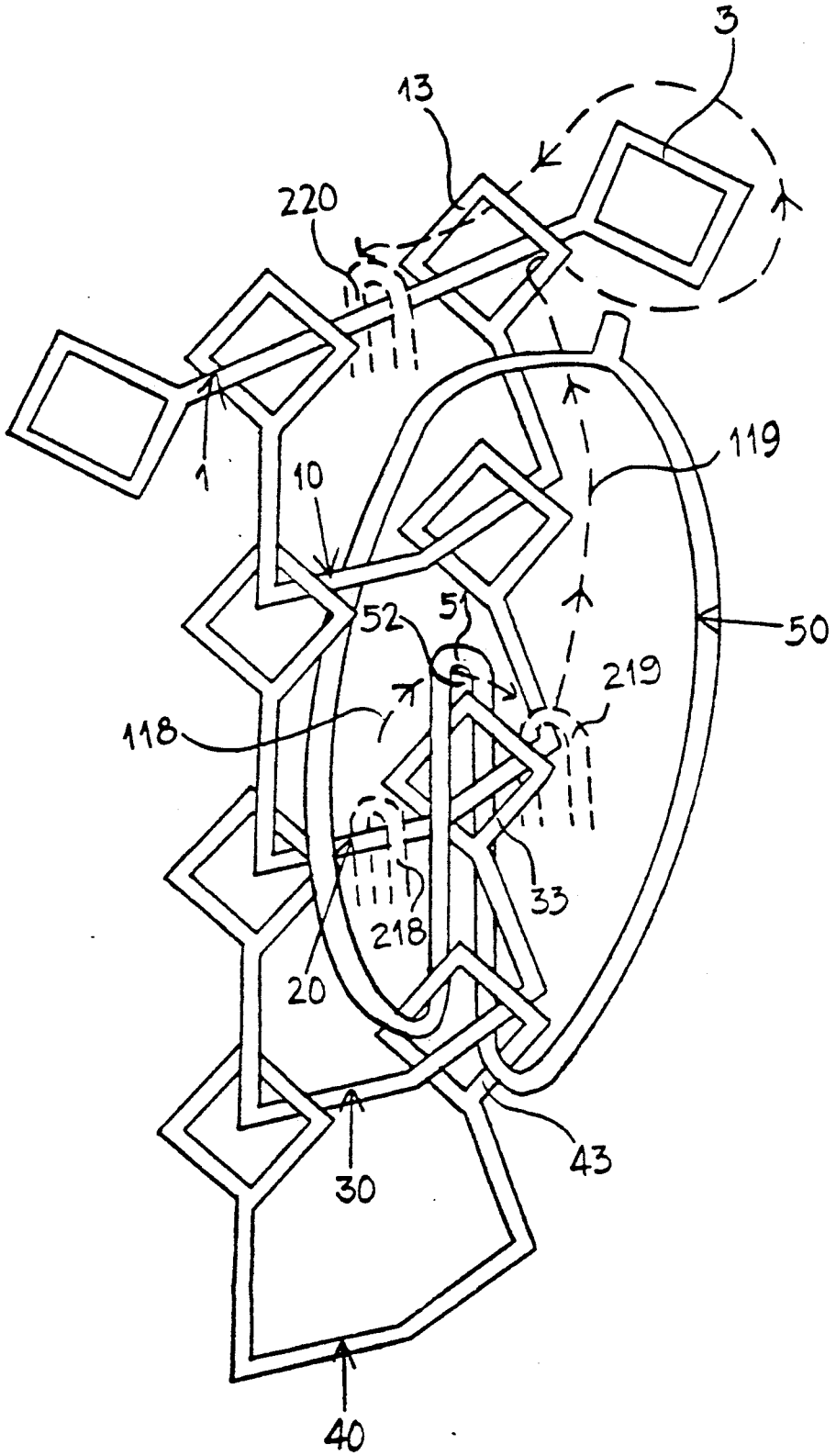
Figure 19:
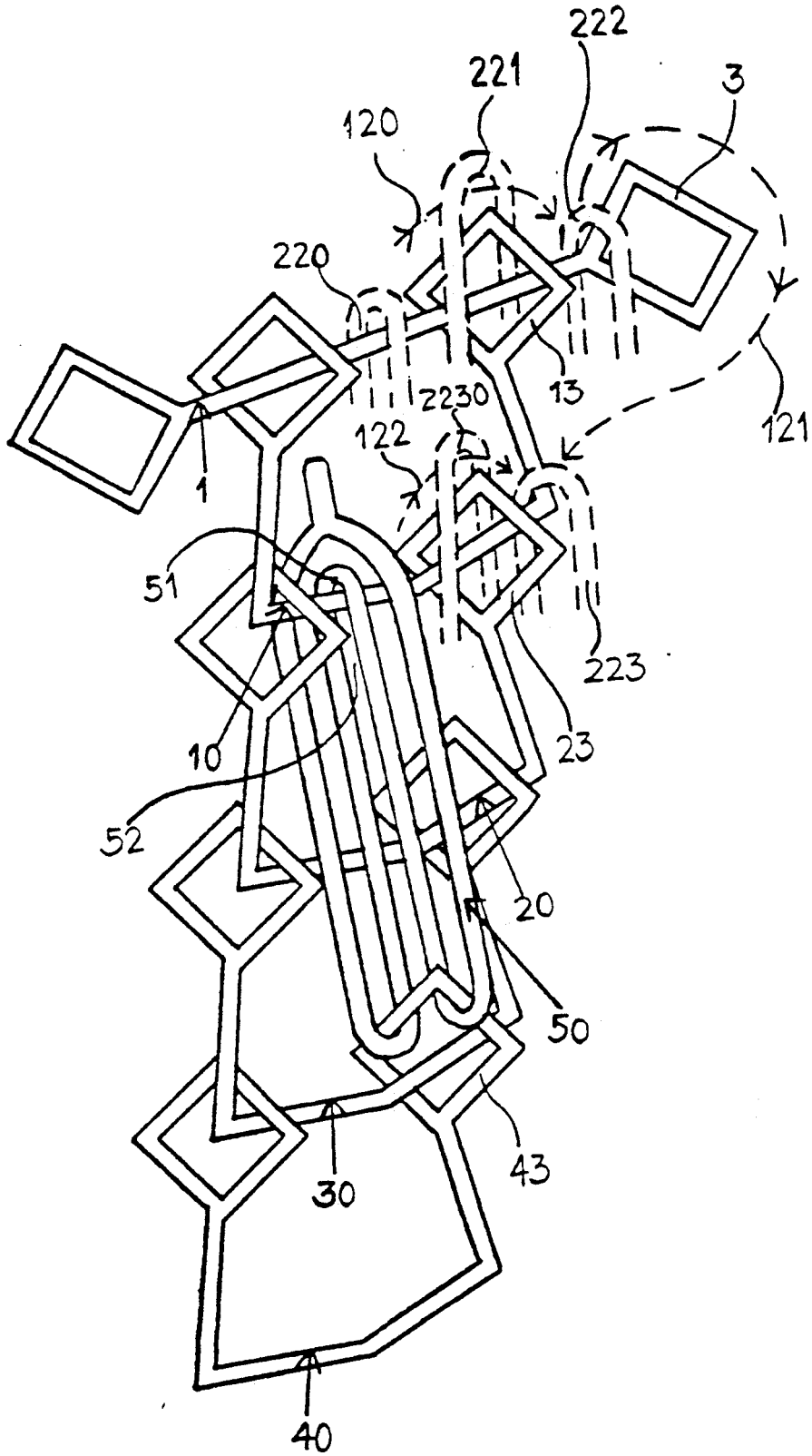
Figure 20:
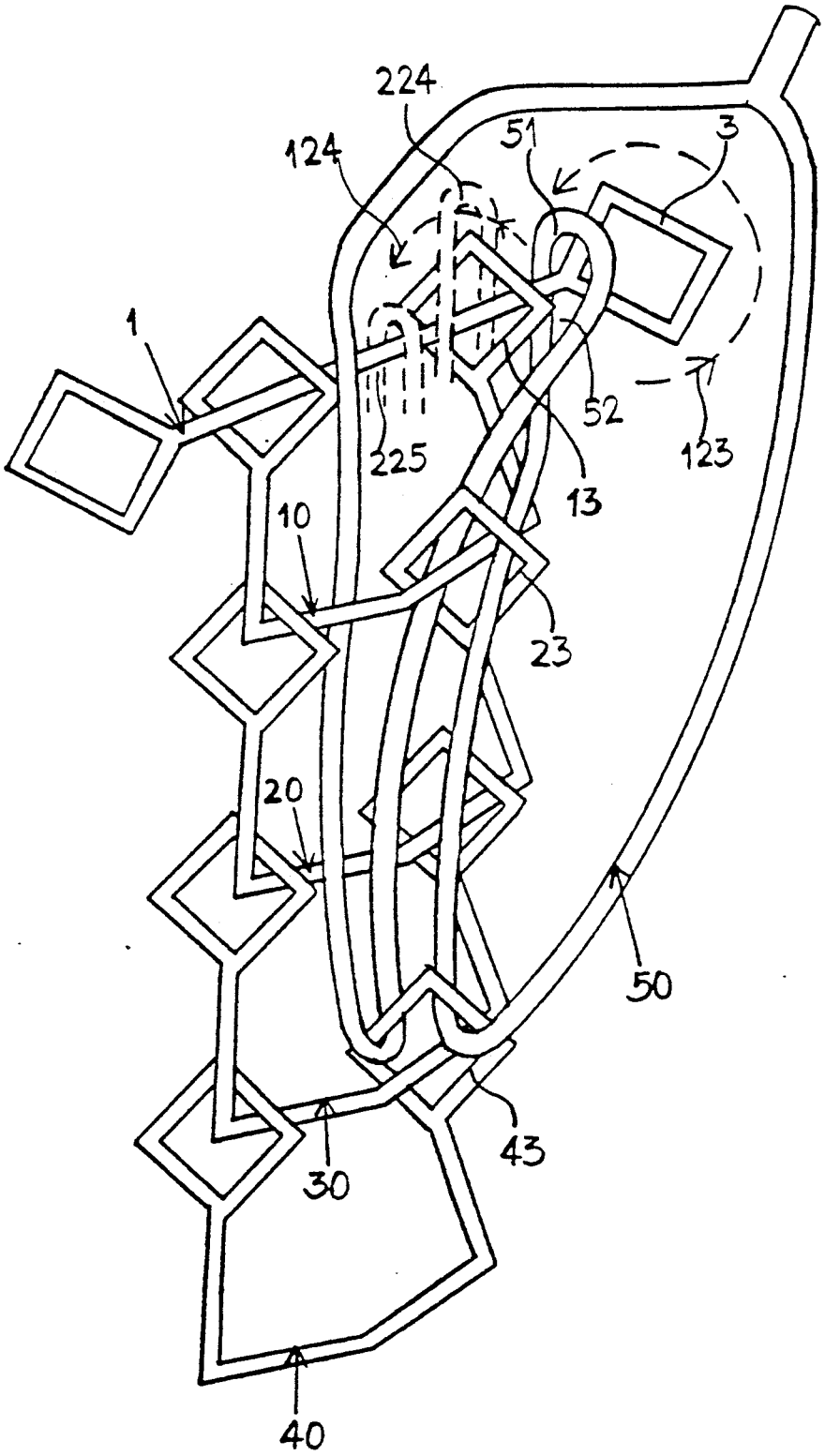
Figure 21:
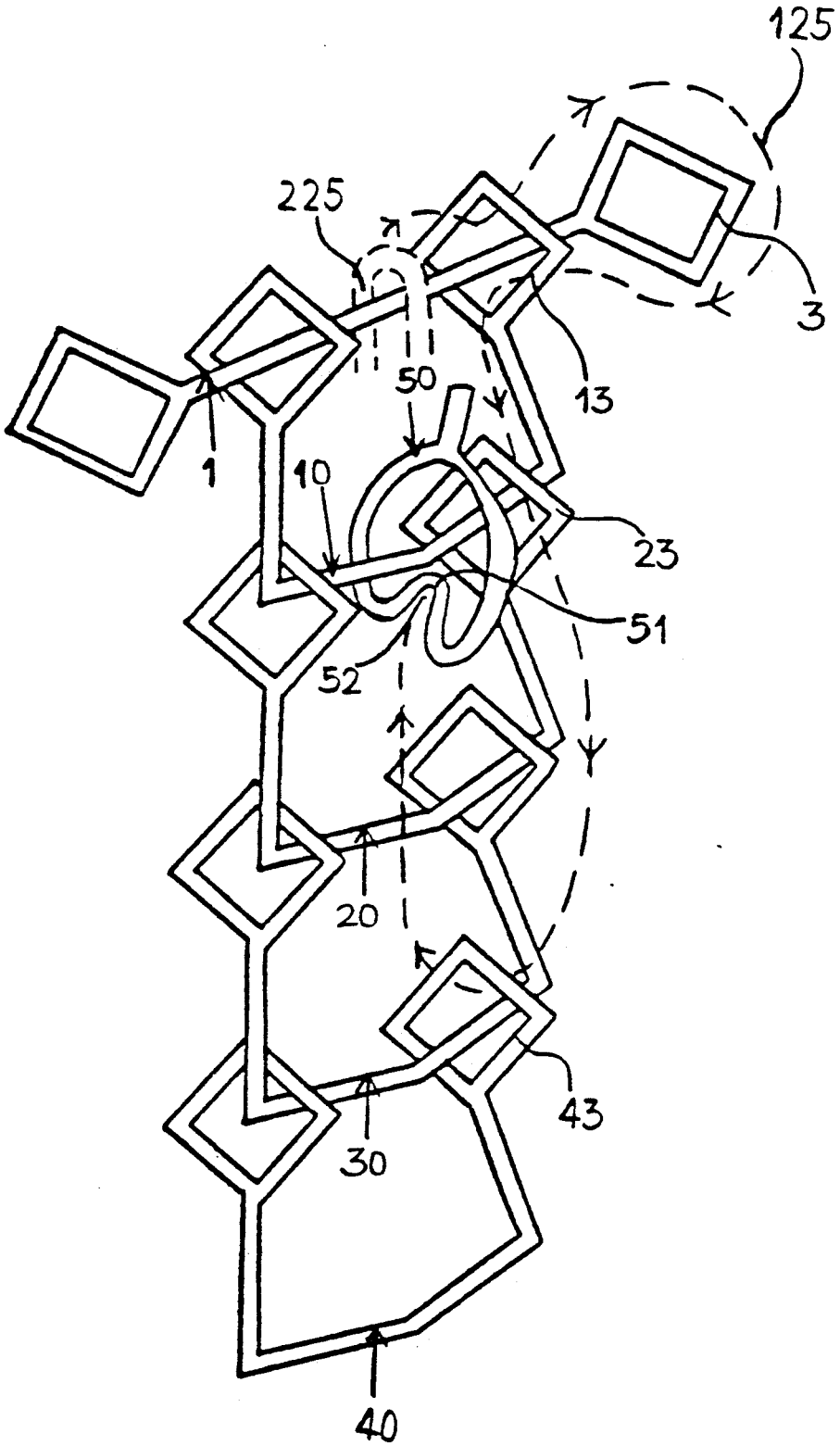

In FIG. 14, centertip 51 is sequentially inserted through binders 43, 33, 23, and 13. Path 111 shows tiphole 52 being passed across anchor 3, and then centertip 51 being removed from binder 13, ending at position 210. In FIG. 15, centertip 51 is initially at position 210. Position 211 shows tiphole 52 being straddled past binder 13 along path 112, with centertip 51 ending at position 212. Path 113 shows tiphole 52 being passed across anchor 3 from position 212, and then centertip 51 being removed from binder 23, ending at position 213. In FIG. 16, with centertip 51 being initially at position 213, tiphole 52 is straddled past binder 23 along path 114, with centertip 51 ending at position 214. Path 115 shows tiphole 52 being passed across anchor 3, with centertip 51 ending at position 215. Then, position 216 shows tiphole 52 being straddled past binder 13 along path 116, with centertip 51 ending at position 217. In FIG. 17, path 117 shows centertip 51 initially at position 217 being inserted into binder 13, then tiphole 52 being passed across anchor 3, and then centertip 51 being sequentially removed from binders 13 and 33, ending at position 218. In FIG. 18, tiphole 52 is straddled past binder 33 from position 218 along path 118, with centertip 51 ending at position 219. Path 119 shows centertip 51 being inserted through binder 13, then tiphole 52 being straddled across anchor 3, and then centertip 51 being removed from binder 13, ending at position 220. In FIG. 19, path 120 shows position 221 having tiphole 52 being straddled past binder 13 from position 220, with centertip 51 ending at position 222. Path 121 shows tiphole 52 being passed across anchor 3 from position 222, with centertip 51 ending at position 223. Position 2230 shows tiphole 52 being straddled past binder 23 along path 122 from position 223, with centertip 51 ending at position of illustrated heart element 50. In FIG. 20, centertip 51 is inserted through binder 23. Path 123 shows tiphole 52 being passed across anchor 3. Position 224 shows tiphole 52 being straddled past binder 13 along path 124, with centertip 51 ending at position 225. In FIG. 21, Path 125 shows centertip 51 being inserted through binder 13 from position 225, then tiphole 52 being passed across anchor 3, and then centertip 51 being sequentially removed from binders 13, 23, and 43, ending at the position of illustrated heart element 50. Follow instructions immediately following the paragraph beginning with the word "LOOP1c".

LOOP3s

Figure 22:
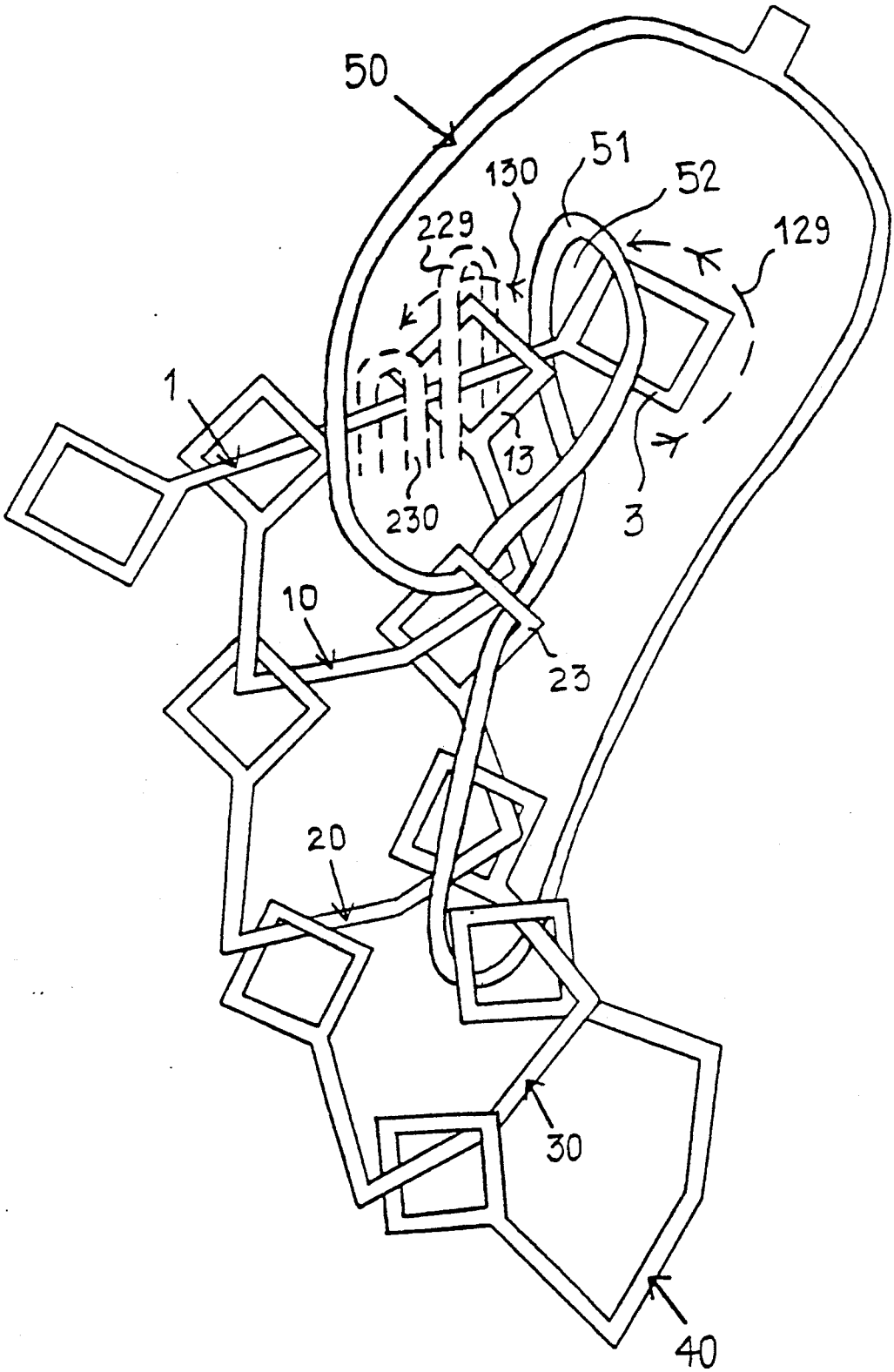
FIGS. 22, 23, 26–29, and 34 illustrate steps involved in removing the heart element from the predetermined position of FIG. 5*f*.
Figure 23:
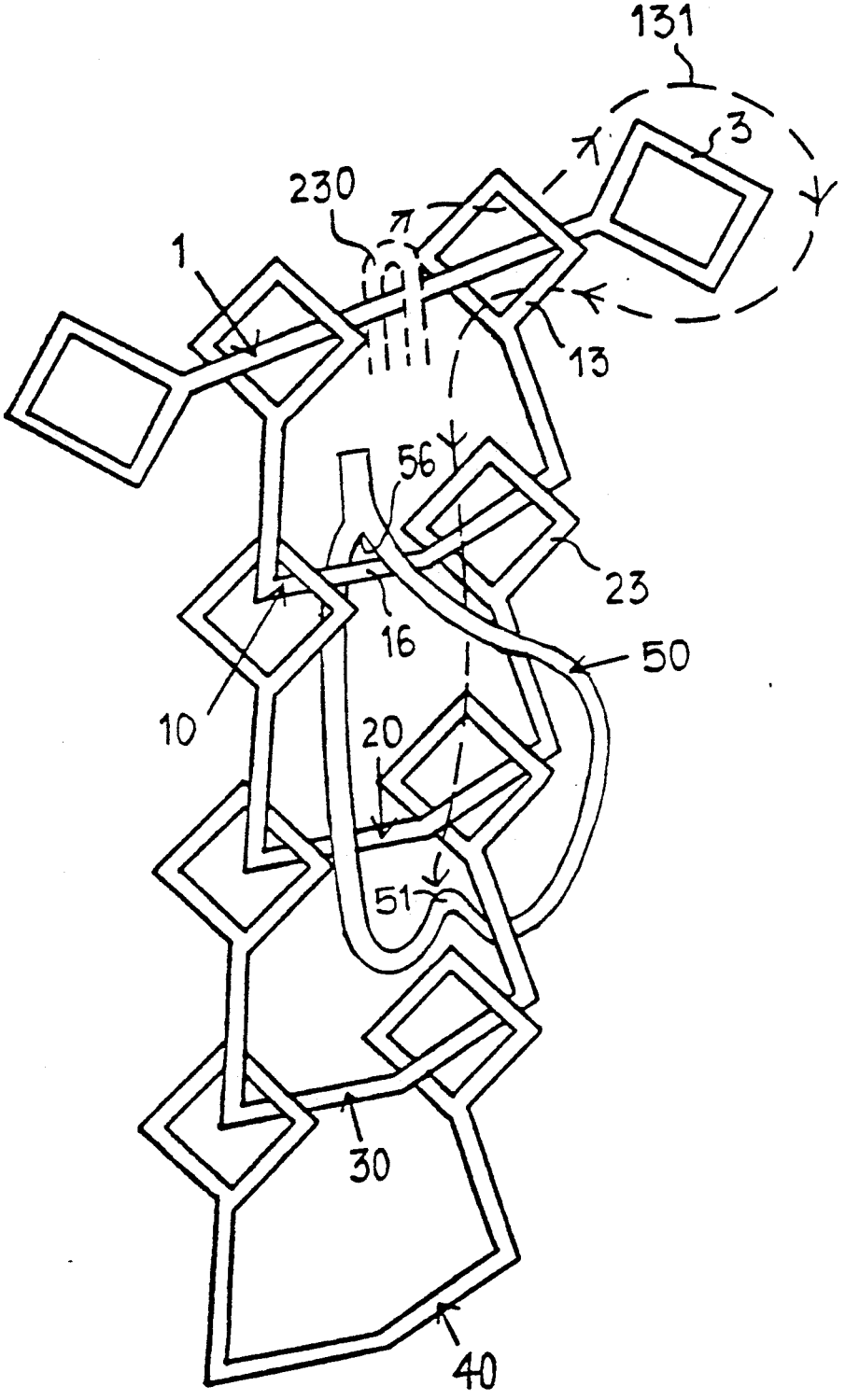

FIG. 22 shows centertip 51 being inserted through binder 23. Path 129 shows tiphole 52 being passed across anchor 3. Position 229 shows tiphole 52 being straddled past binder 13 along path 130, with centertip 51 ending at position 230. In FIG. 23, path 131 shows centertip 51 initially at position 230, being inserted through binder 13, then tiphole 52 being passed across anchor 3, then centertip 51 being sequentially removed from binders 13 and 23, ending at the illustrated position of heart element 50, with apex 56 retaining rung 16. Follow instructions immediately after the paragraph beginning with the word "LOOP2c.1".

LOOP2c

Figure 24:
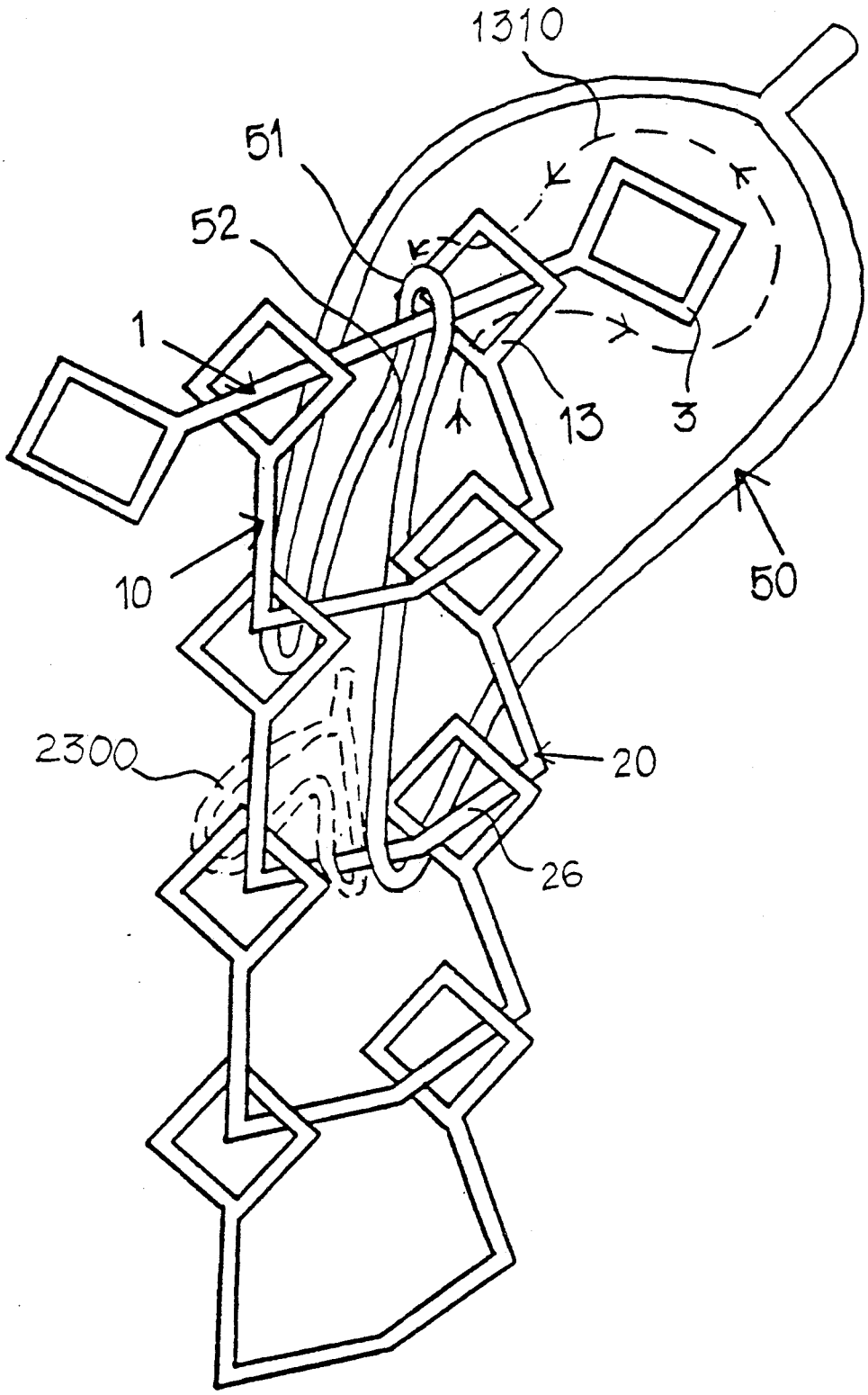
Figure 25:
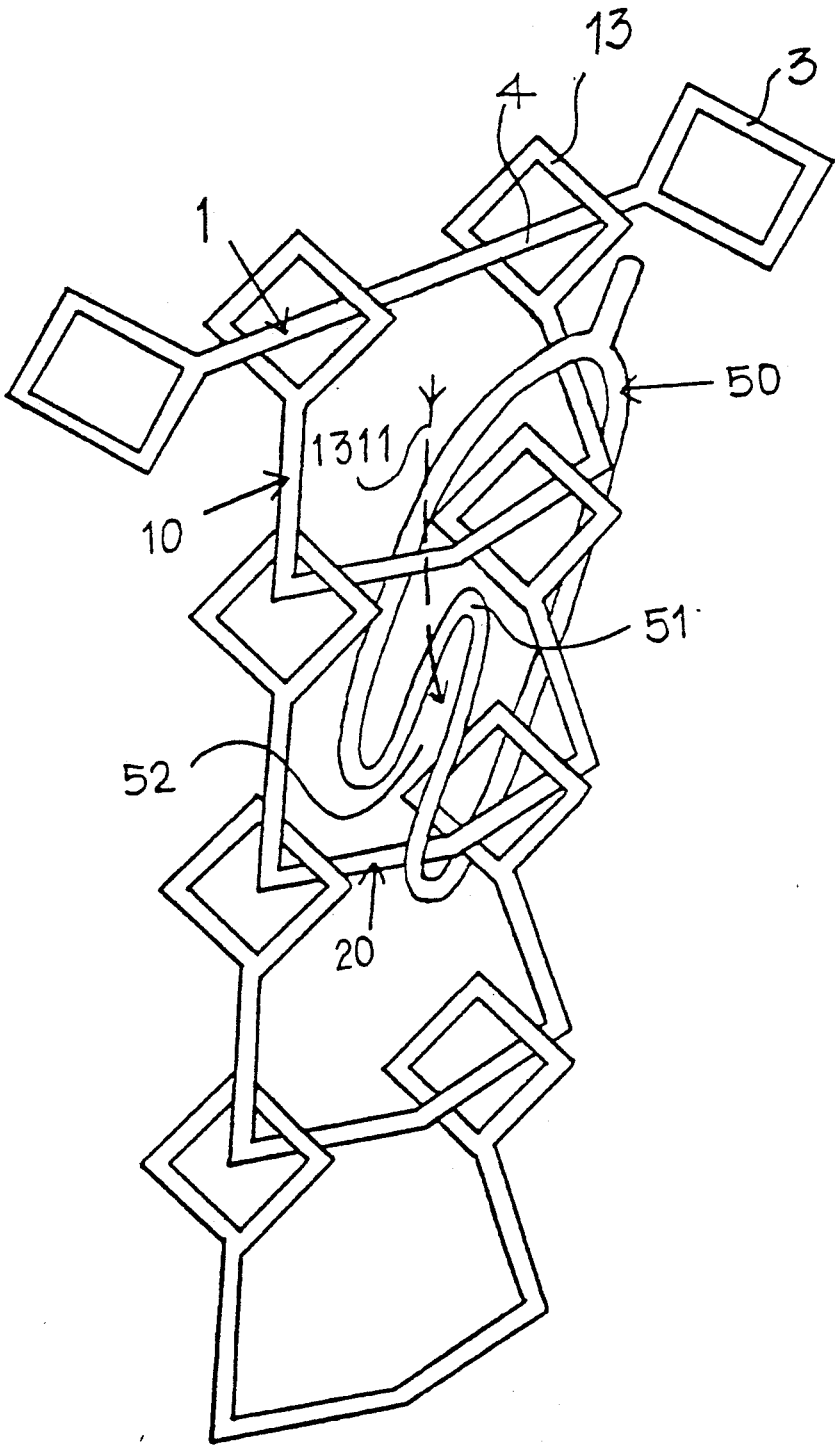

FIG. 24 shows heart element 50 initially at position 2300. Path 1310 shows centertip 51 being inserted through binder 13 with heart element 50 being behind U-shaped element 10, then tiphole 52 being passed across anchor 3, and then centertip 51 being removed from binder 13. FIG. 25 shows path 1311 leading centertip 52 to the position of the illustrated heart element 50. Follow instructions immediately after the paragraph beginning with the word "LOOP2c.1".

LOOP2c.1

Figure 26:
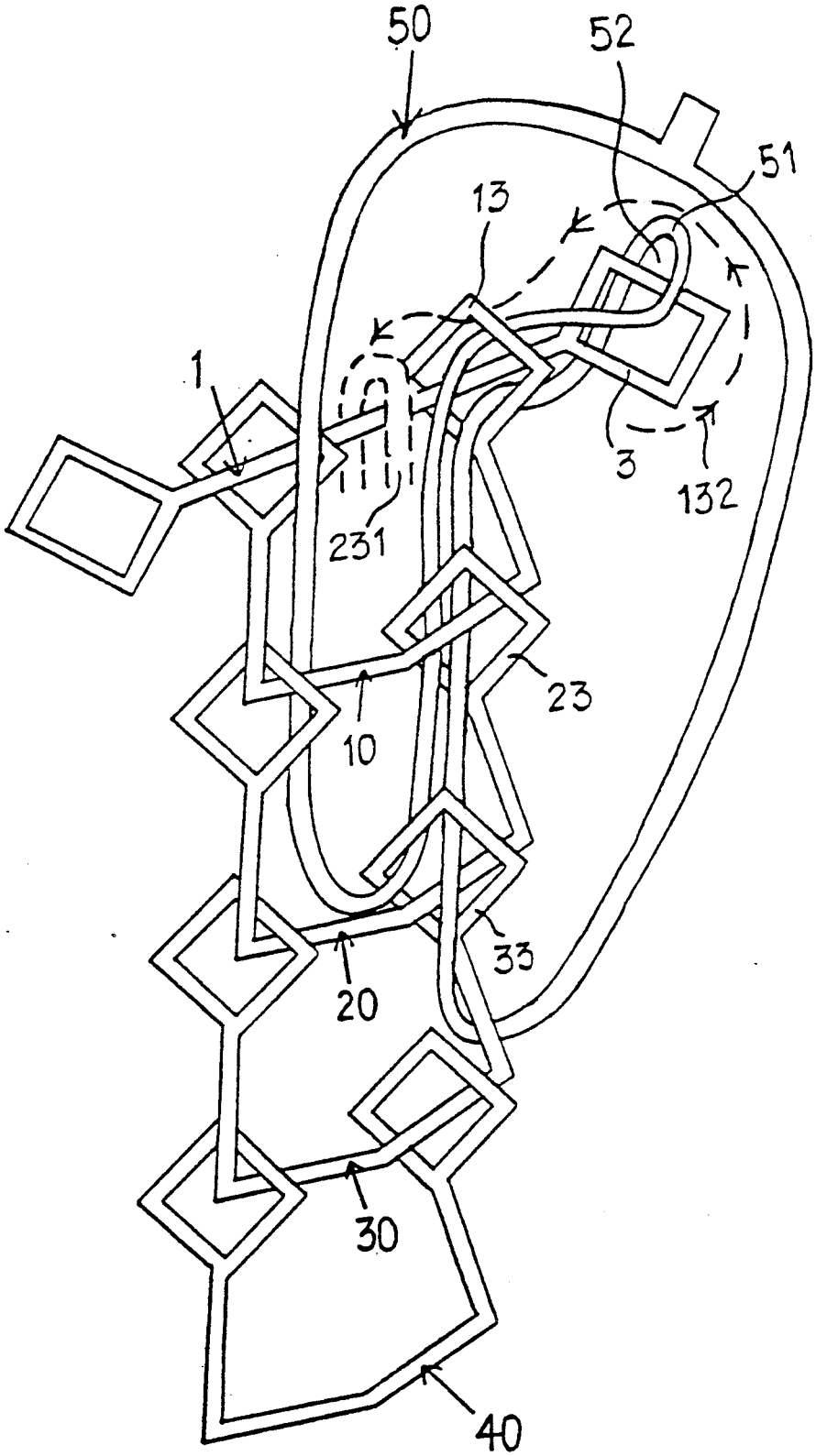
Figure 27:
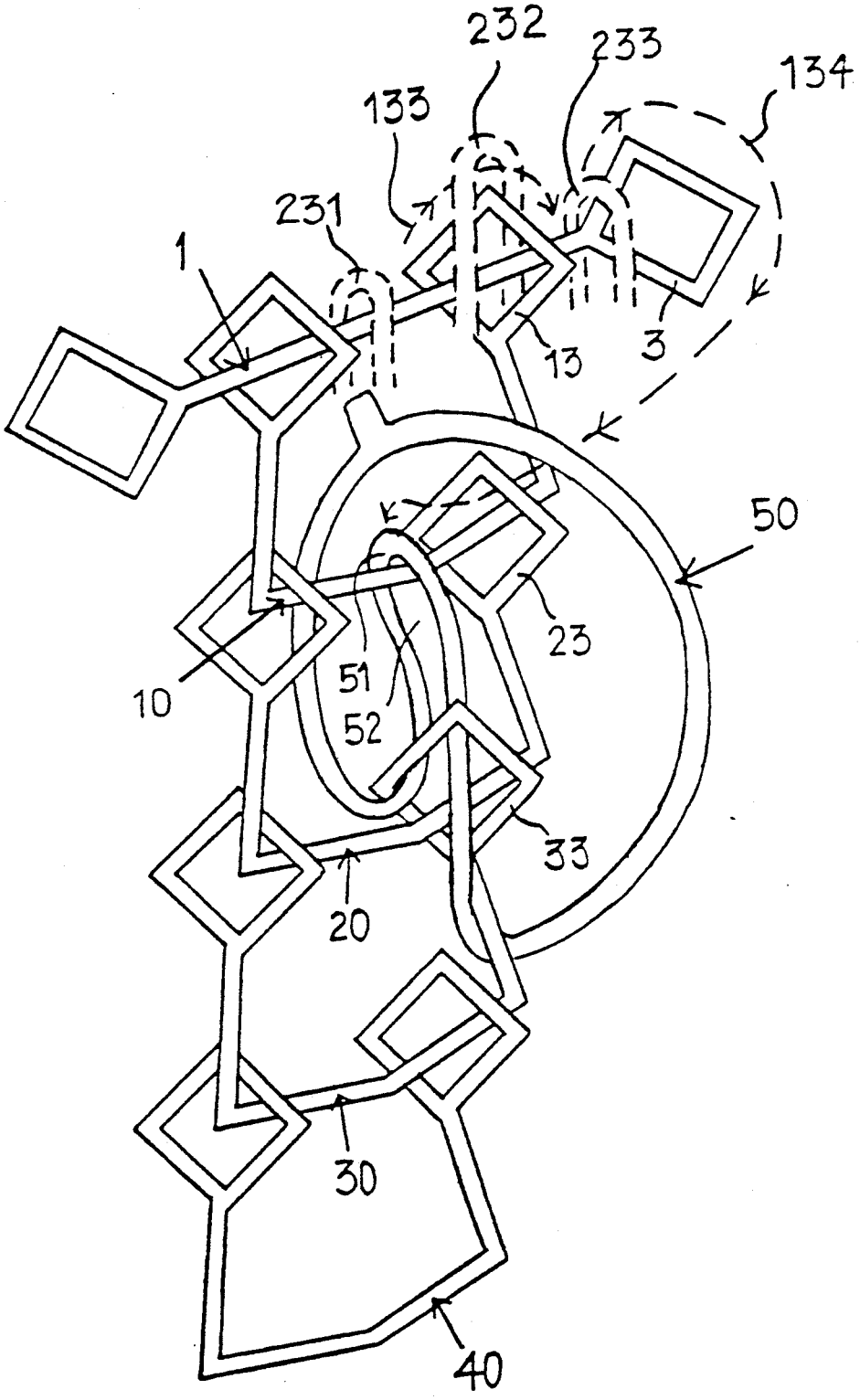
Figure 28:
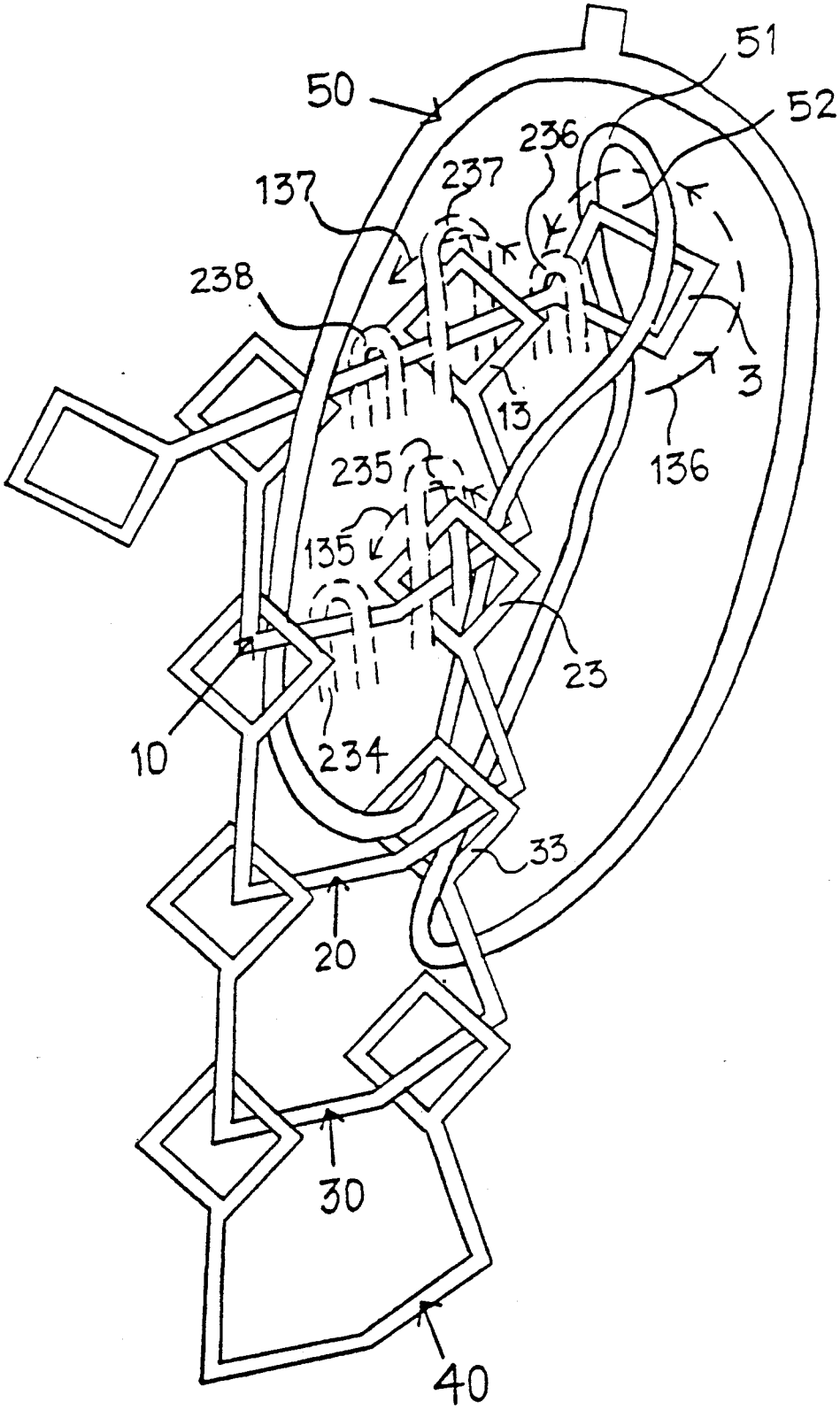
Figure 29:
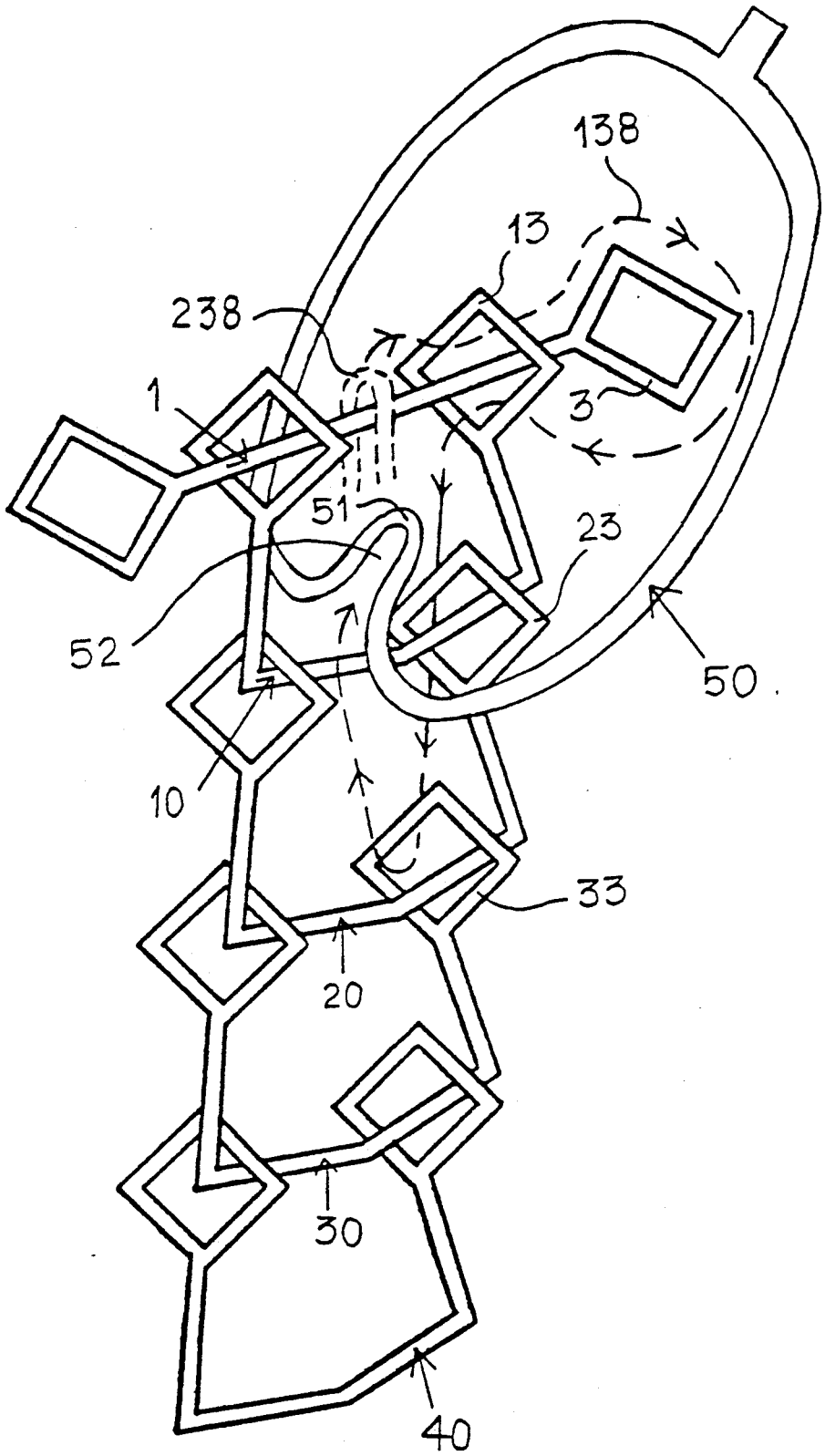

In FIG. 26, centertip 51 is sequentially inserted through binders 33, 23, and 13. Path 132 shows tiphole 52 being passed across anchor 3, then centertip 51 being removed from binder 13, ending at position 231. In FIG. 27, position 232 shows tiphole 52 being straddled past binder 13 along path 133 from position 231, with centertip 51 ending at position 233. Path 134 shows tiphole 52 being passed across anchor 3, and then centertip 51 being removed from binder 23. In FIG. 28, position 235 shows tiphole 52 being straddled past binder 23 along path 135 from position 234. Path 136 shows tiphole 52 being passed across anchor 3, ending at position 236. Position 237 shows tiphole 52 being straddled across binder 13 along path 137 from position 236, with centertip 51 ending at position 238. In FIG. 29, path 138 show centertip 51 initially at position 238 being inserted through binder 13, then tiphole 52 being passed across anchor 3, and then centertip 51 being sequentially removed from binders 13, and 33. Follow instructions immediately after the paragraph beginning with the word "LOOP1s".

LOOP2s

Figure 30:
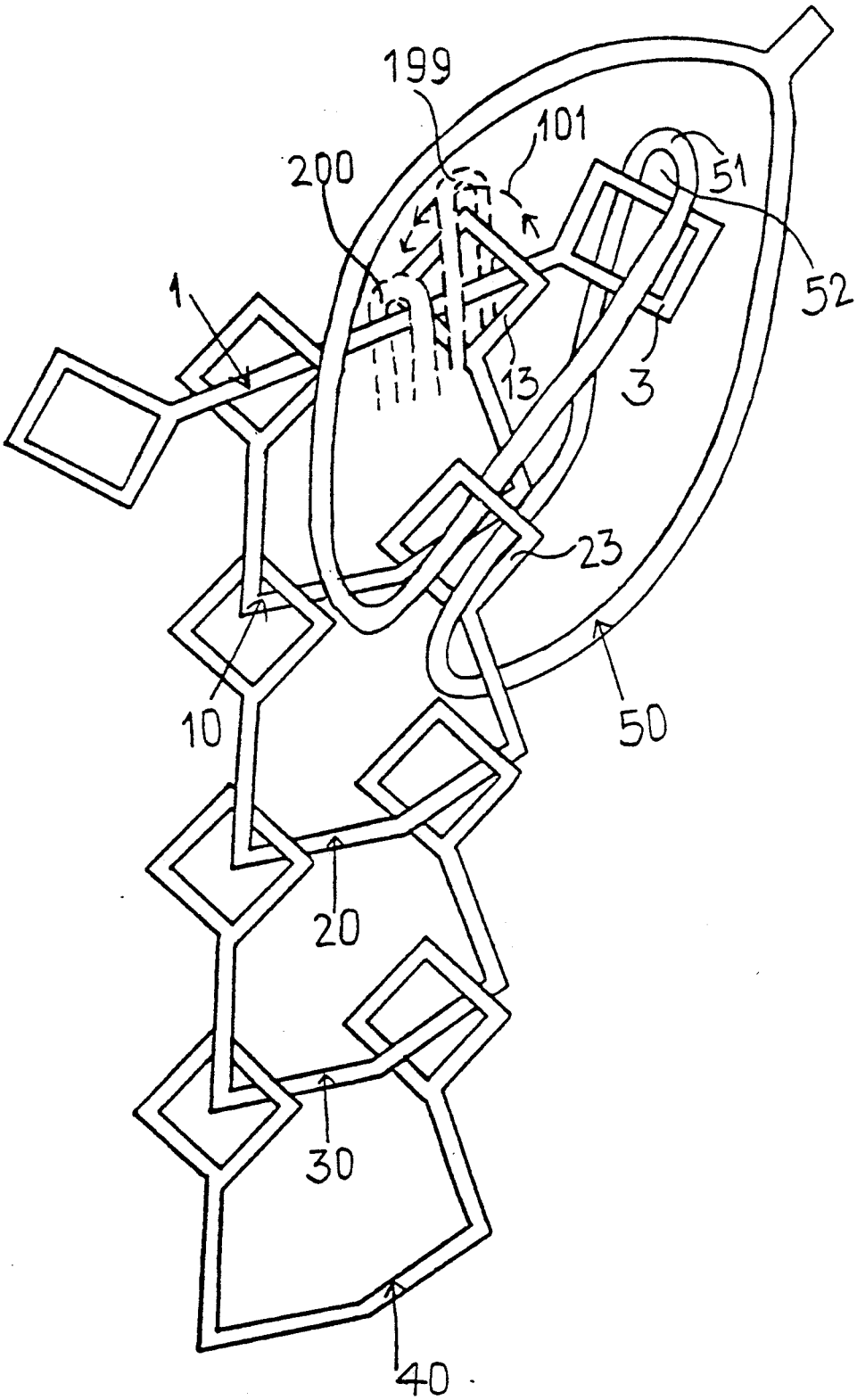
FIGS. 30 and 31 illustrate steps involved in removing the heart element from the predetermined position of FIG. 5*c*.
Figure 31:
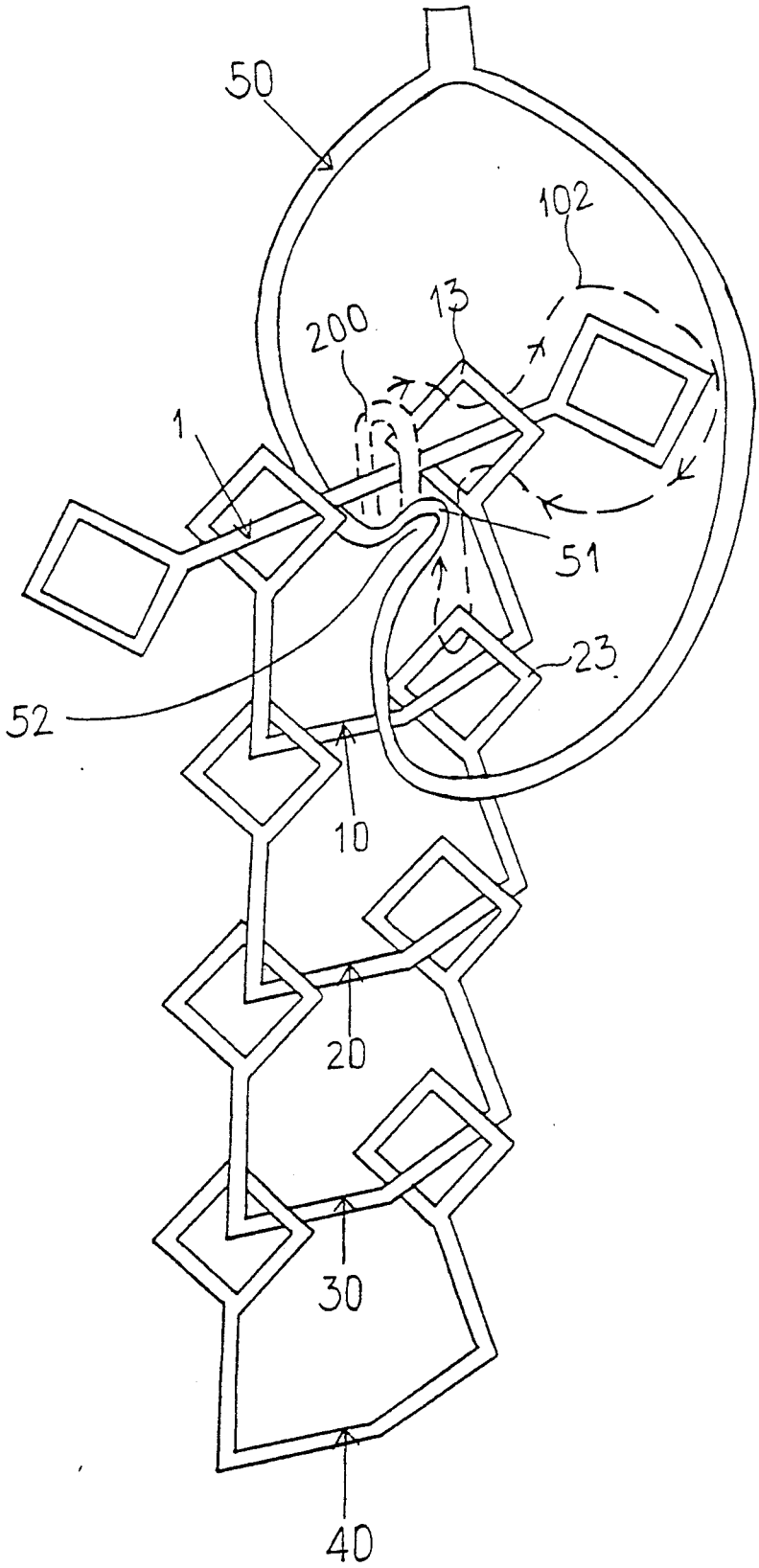

FIG. 30 shows centertip 51 being inserted through binder 23, then tiphole 52 being passed across anchor 3, and then being straddled past binder 13 along path 101 as shown at position 199, with centertip 51 ending at position 200. In FIG. 31, path 102 shows centertip 51 initially at position 200 being inserted through binder 13, then tiphole 52 being passed across anchor 3, and then centertip 51 being sequentially removed from binders 13 and 23. Follow instructions immediately after the paragraph beginning with the word "LOOP1s".

LOOP1c

Figure 32:
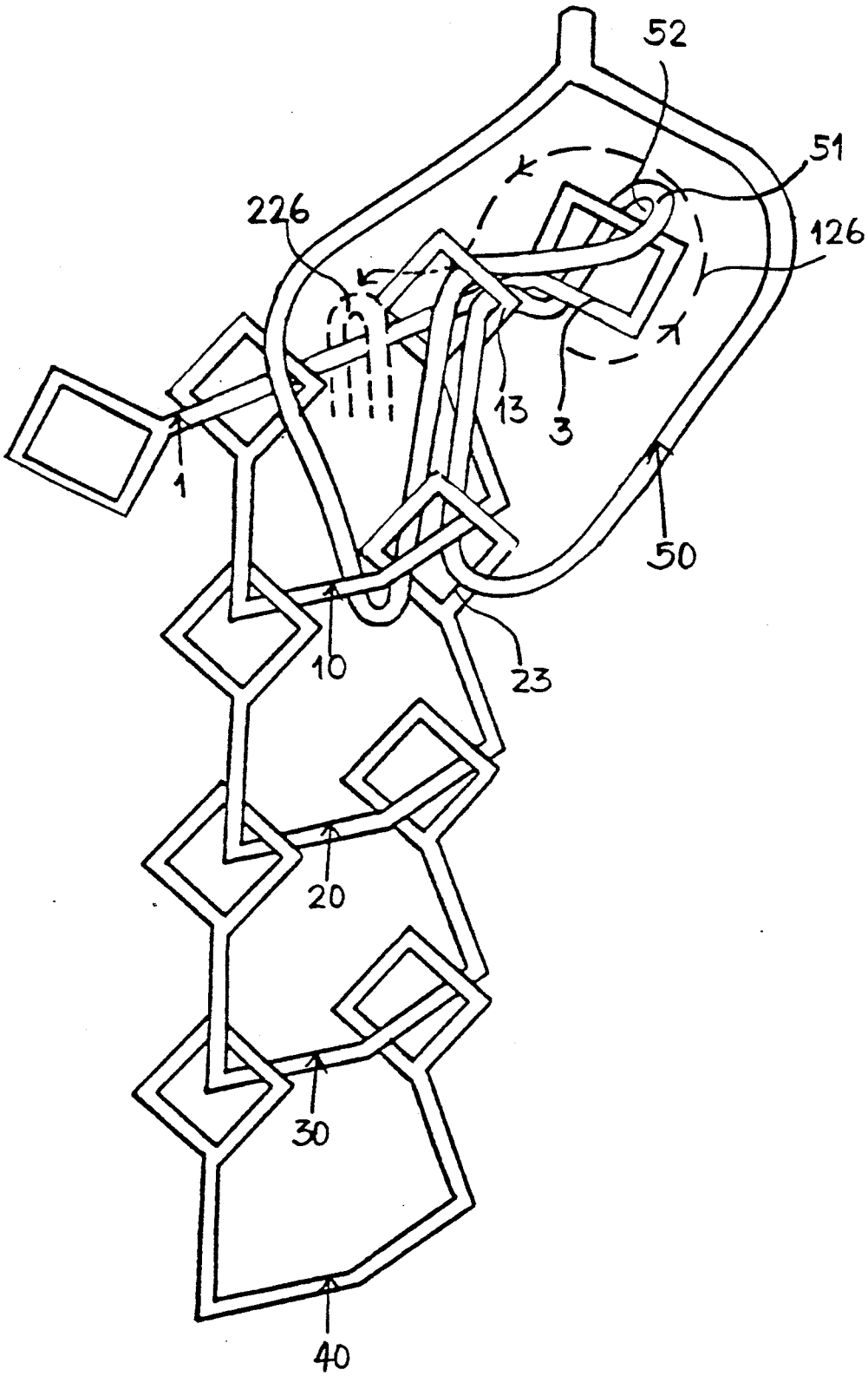
Figure 33:
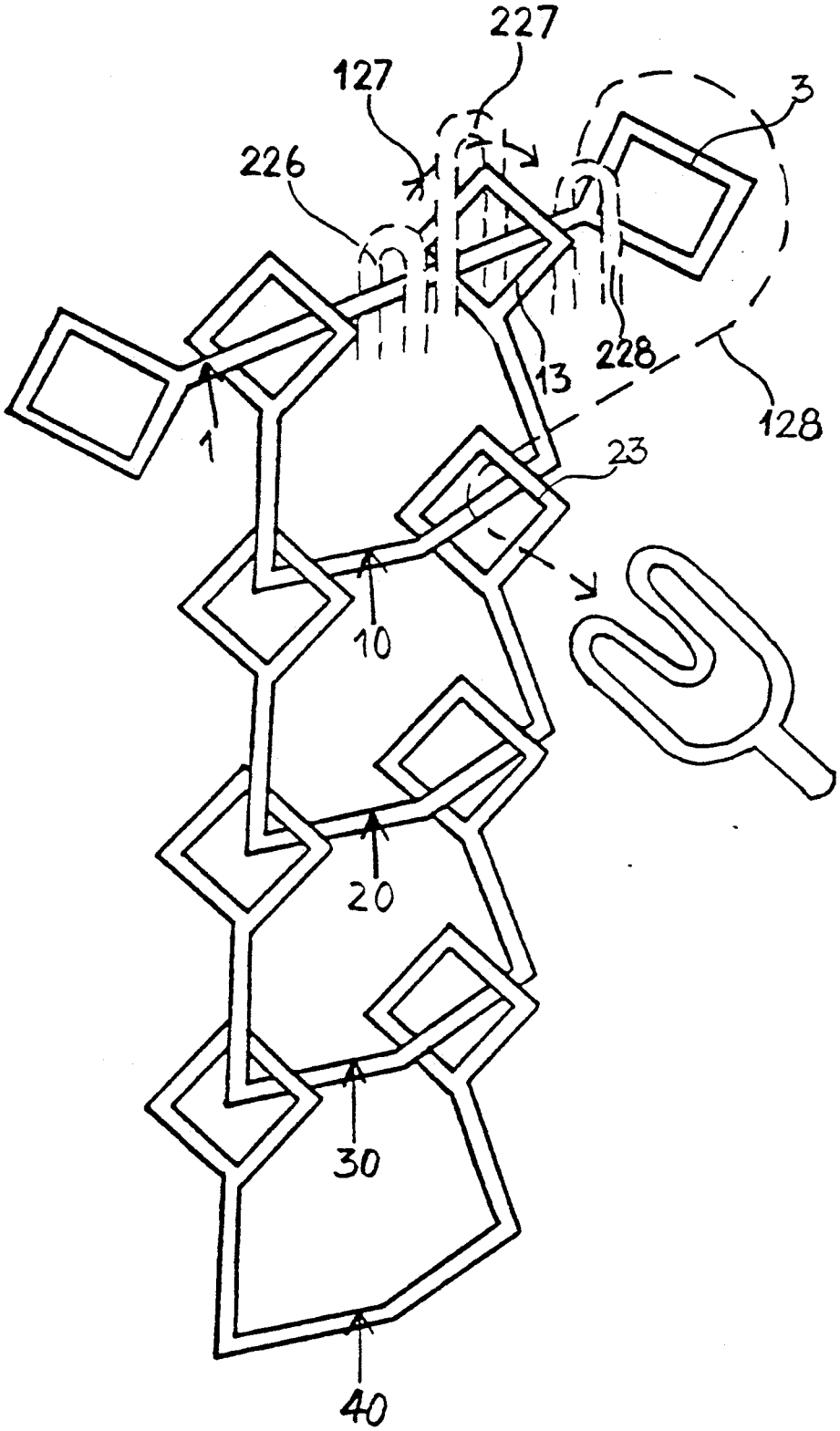

FIG. 32 shows centertip 51 being sequentially inserted into binders 23 and 13. Path 126 shows tiphole 52 being passed across anchor 3, and then centertip 51 being removed from binder 13, ending at position 226. In FIG. 33, path 127 shows position 227 having tiphole 52 being straddled past binder 13 from position 226, with centertip 51 ending at position 228. Path 128 shows tiphole 52 being passed across anchor 3 from position 228, and then centertip 51 being removed from binder 23, thereby releasing heart element 50. END.

LOOP1s

Figure 34:
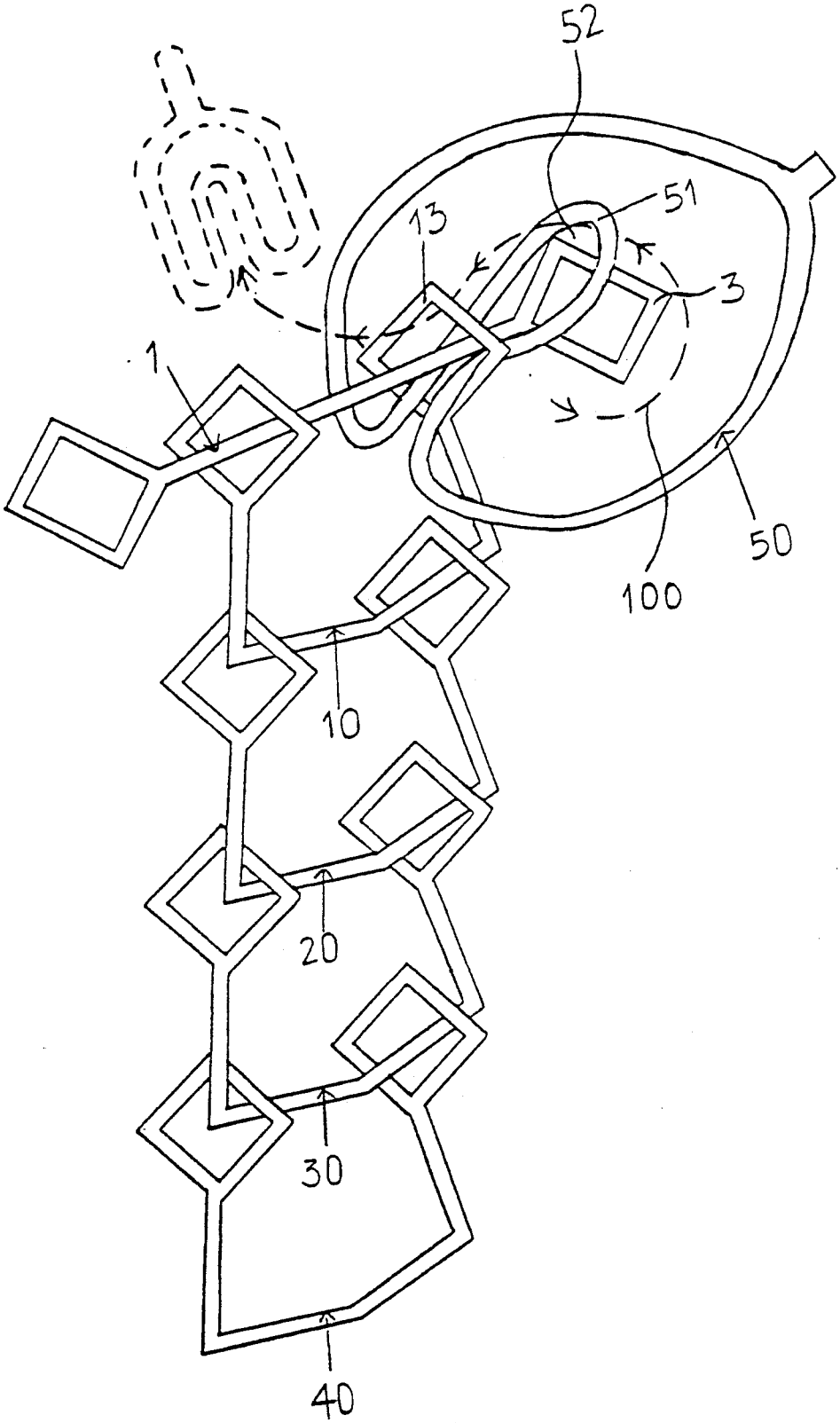

In FIG. 34, centertip 51 is inserted through binder 13. Tiphole 52 is passed across anchor 3 along path 100, and then centertip 51 is removed from binder 13, thereby freeing heart element 50. END It is understood that improvements, modifications, and additions may be made herein, and such changes being considered as included in the following claims.

I claim:

1. A puzzle comprising:

A first crossbar element comprising of a rod portion with first opposite ends, and of a first and a second closed loops attached to said first opposite ends;

A first U-shaped element comprising of a first U-shaped portion and first dual loops, with said first dual loops comprising of a third and a fourth closed loops, with said third closed loop attached to a first end of said first U-shaped portion, and with said fourth closed loop attached to a second end of said first U-shaped portion, and with said first dual loops encircling said rod portion;

A game element comprising of a closed loop portion;

Means to pass said first crossbar element through said third and said fourth closed loops, with said means to pass comprising of a first flanged portion on said first crossbar element at a first juncture where said first closed loop and said rod portion are joined;

Means to restrict removal of said first crossbar element from said third and said fourth closed loops, with said means to restrict comprising of a second, a third, and a fourth flanged portions on said first crossbar element, with said second flanged portion at a second juncture where said first closed loop and said rod portion are joined, with said third flanged portion at a third juncture where said second closed loop and said rod portion are joined, with said fourth flanged portion at a fourth juncture where said second closed loop and said rod portion are joined, with said second, said third, and said fourth flanged portions being larger than said first flanged portion.

2. A puzzle as set forth in claim 1 comprising of a series of one or more secondary U-shaped elements connected to said first U-shaped element, with said secondary U-shaped elements each comprising of secondary dual loops and of one secondary U-shaped portion having dual ends; with said secondary dual loops, comprising two secondary closed loops, each being attached to each of said dual ends, with said secondary U-shaped elements being adapted to be attached together in said series thru said secondary closed loops of one of said secondary U-shaped elements encircling said one secondary U-shaped portion of another of said secondary U-shaped elements, with said secondary closed loops of a secondary U-shaped element in said series encircling said first U-shaped portion of said first U-shaped element.

3. A puzzle as set forth in claim 2 wherein said first, second, third, fourth and secondary closed loops comprise of similarly sized shape means to pass said closed loops through each other.

4. A puzzle as set forth in claim 2 wherein said U-shaped element comprise of generally identical dimensions.

5. A puzzle as set forth in claim 2 wherein said closed loop portion of said game element comprises of a planar heart-shaped element, with said planar heart-shaped element comprising of a large upright generally U-shaped portion containing a small upright generally U-shaped portion central to said large upright generally U-shaped portion, with opposite ends of a first lobe attached to left ends of said large and said small upright U-shaped portions and with opposite ends of a second lobe attached to right ends of said large and said small upright U-shaped portions to form an enclosed space.

6. A puzzle as set forth in claim 5 wherein said planar heart-shaped elements each comprises of said means of support.

7. A puzzle as set forth in claim 1 wherein said closed loop portion of said game element comprises of a planar heart-shaped element, with said planar heart-shaped element comprising of a large upright generally U-shaped portion containing a small upright generally U-shaped portion central to said large upright generally U-shaped portion, with opposite ends of a first lobe attached to left ends of said large and said small upright U-shaped portions, and with opposite ends of a second lobe attached to right ends of said large and said small upright U-shaped portions to form an enclosed space.

8. A puzzle as set forth in claim 7 wherein said planar heart-shaped element comprises of a means of support consisting of a first protruding portion attached to said large upright generally U-shaped portion, with said protruding portion not forming and not occupying said enclosed space.

* * * * *